US006148695A

United States Patent [19]

Hu

[11] Patent Number: 6,148,695

[45] Date of Patent: Nov. 21, 2000

[54] RATCHET WHEEL WITH ASYMMETRIC ARCUATE CONCAVE TEETH OR NON-ARCUATE CONCAVE TEETH AND RATCHETING TOOLS WITH SUCH RATCHET WHEEL

[76] Inventor: Bobby Hu, 8th Floor, Suite 1, No. 536, Da-Jinn Street, Nan Twen, Taichung, Taiwan

[21] Appl. No.: 09/365,738

[22] Filed: Aug. 3, 1999

[51] Int. Cl.[7] ..... B25B 13/46

[52] U.S. Cl. ..... 81/60; 81/63.1

[58] Field of Search ..... 81/60, 62, 63.1

[56] References Cited

U.S. PATENT DOCUMENTS 2,317,461 4/1943 Jackson ..... 81/60

2,764,048 9/1956 Thompson ..... 81/60 X 4,991,468 2/1991 Lee ..... 81/60

5,636,557 6/1997 Ma ..... 81/60

*Primary Examiner*—Derris H. Banks

*Assistant Examiner*—Anthony Ojini

*Attorney, Agent, or Firm*—Rosenberg, Klein & Lee

[57] ABSTRACT

A ratchet wheel includes an inner periphery and an outer periphery. The outer periphery includes a number of arcuate concave teeth each having two sides and an intersection of the two sides. The ratchet wheel includes a center, a line from the center to the intersection dividing an angle between the two sides into two unequal portions, thereby forming asymmetric arcuate concave teeth to provide improved structural strength and improved torque. In another embodiment, the concave teeth are non-arcuate to reduce the formation time for the teeth, thereby reducing the production cost.

20 Claims, 26 Drawing Sheets

RATCHET WHEEL WITH ASYMMETRIC ARCUATE CONCAVE TEETH OR NON-ARCUATE CONCAVE TEETH AND RATCHETING TOOLS WITH SUCH RATCHET WHEEL

BACKGROUND OF THE INVENTION

1. Field of the Invention

The present invention relates to a ratchet wheel with asymmetric arcuate concave teeth or non-arcuate concave teeth. The present invention also relates to a ratcheting tool, e.g., a ring spanner having a box end in which the ratchet wheel is mounted. The ratchet wheel with asymmetric arcuate concave teeth provides improved structural strength and improved torque. The ratchet wheel with non-arcuate concave teeth is easy to form and thus reduces the production cost.

2. Description of the Related Art

A wide variety of spanners and wrenches have heretofore been provided. Ring spanners are the best choice for driving fasteners (e.g., nuts, bolt heads, etc) in a limited space that is uneasy to access and difficult to operate all kinds of ratcheting tools. Nevertheless, conventional ring spanners have low driving torque. Ratchet type ring spanners have been proposed to solve this problem. A ratchet wheel is mounted in the box end of a ring spanner for driving fasteners at high torque. It is, however, found that, the structural strength of the ratchet wheel is weak, as an outer periphery of the ratchet wheel is processed to form a plurality of arcuate teeth with a considerable depth.

FIGS. 11 through 13 of the drawings illustrate a conventional ratchet wheel 1 mounted in a box end (not shown) of a ring spanner (not shown) and having an inner periphery 4 for driving a fastener (not shown) and an outer periphery having a plurality of arcuate concave teeth 3. Referring to FIG. 12, each arcuate concave tooth 3 is formed by means of feeding a cutter 2 along a direction transverse to a radial direction (see line OR). The resultant concave tooth 3 has a depth "d" and two sides that intersect at point "R". The line OR divides the angle $\alpha$ defined by the two sides of the arcuate concave tooth 3 into two equal portions (usually 45° for each portion). As illustrated in FIG. 12, each arcuate concave tooth 3 is machined to have a considerable depth "d" that adversely affects the structural strength of the ratchet wheel 1, as the remaining wall thickness "t" of the ratchet wheel 1 is relatively small. As a result, the driving torque provided by the ratchet wheel for driving the fastener is limited.

FIGS. 14 through 16 of the drawings illustrate a conventional ratchet wheel 5 mounted in a box end 9*a* (FIG. 17) of a ring spanner 9 (FIG. 17) and having an inner periphery 8 for driving a fastener (not shown) and an outer periphery having a plurality of arcuate concave teeth 6. Referring to FIG. 15, each arcuate concave tooth 6 is formed by means of feeding a cutter 7 along a radial direction. The resultant arcuate concave tooth 6 has a depth "d" and two sides that intersect at point "R". The line OR divides the angle $\beta$ defined by the two sides of the concave tooth 6 into two equal portions (usually 45° for each portion). As illustrated in FIG. 15, each arcuate concave tooth 6 is machined to have a considerable depth "d" that adversely affects the structural strength of the ratchet wheel, as the remaining wall thickness "t" of the ratchet wheel 5 is relatively small. As a result, the driving torque provided by the ratchet wheel for driving the fastener is limited. Such structure has been disclosed in U.S. Pat. No. 5,533,427 to Chow issued on Jul. 9, 1996, which is incorporated herein for reference. A further drawback of this conventional ratchet wheel is the low production rate for forming the arcuate concave teeth by cutting.

The present invention is intended to provide an improved ratchet wheel that mitigates and/or obviates the above problems.

SUMMARY OF THE INVENTION

It is a primary object of the present invention to provide an improved ratchet wheel has asymmetric arcuate concave teeth for providing improved structural strength and improved torque.

It is another object of the present invention to provide an improved ratchet wheel that has non-arcuate concave teeth to allow higher production rate, as the non-arcuate concave teeth can be formed by means of roll squeezing method, investment casting, or molding. The non-arcuate concave teeth may be symmetric or asymmetric. The ratchet wheel with non-arcuate concave teeth may bear higher torque during ratcheting (i.e., tightening or loosening a fastener).

The present invention also provides a ratcheting tool, e.g., a spanner, equipped with a ratchet wheel in accordance with the present invention. In an embodiment of the invention, the spanner has a box end for receiving a ratcheting wheel with asymmetric arcuate concave teeth. In another embodiment of the invention, the spanner has a box end for receiving a ratcheting wheel with non-arcuate asymmetric concave teeth. In a further embodiment of the invention, the spanner has a box end for receiving a ratcheting wheel with non-arcuate symmetric concave teeth.

Other objects, advantages, and novel features of the invention will become more apparent from the following detailed description when taken in conjunction with the accompanying drawings.

DETAILED DESCRIPTION OF THE PREFERRED EMBODIMENTS

Figure 1:
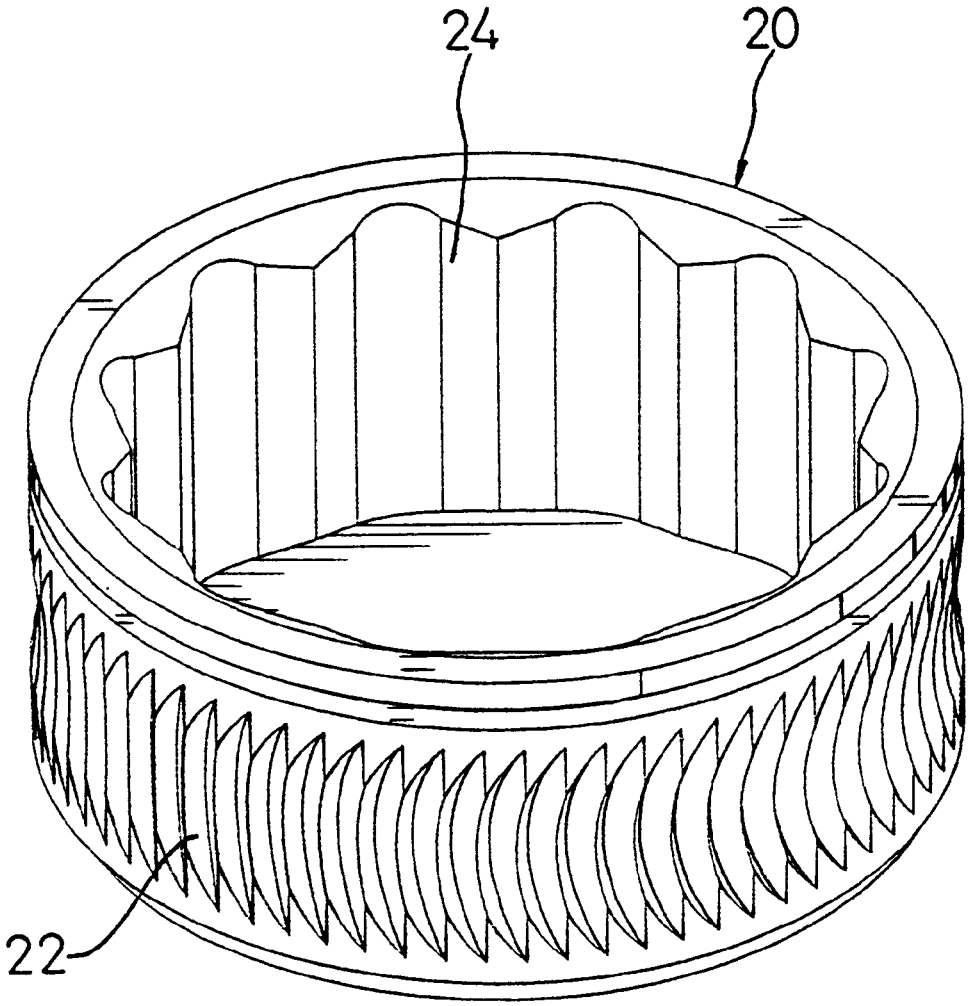
FIG. 1 is a perspective view of a ratchet wheel with asymmetric arcuate concave teeth in accordance with the present invention.
Figure 2:
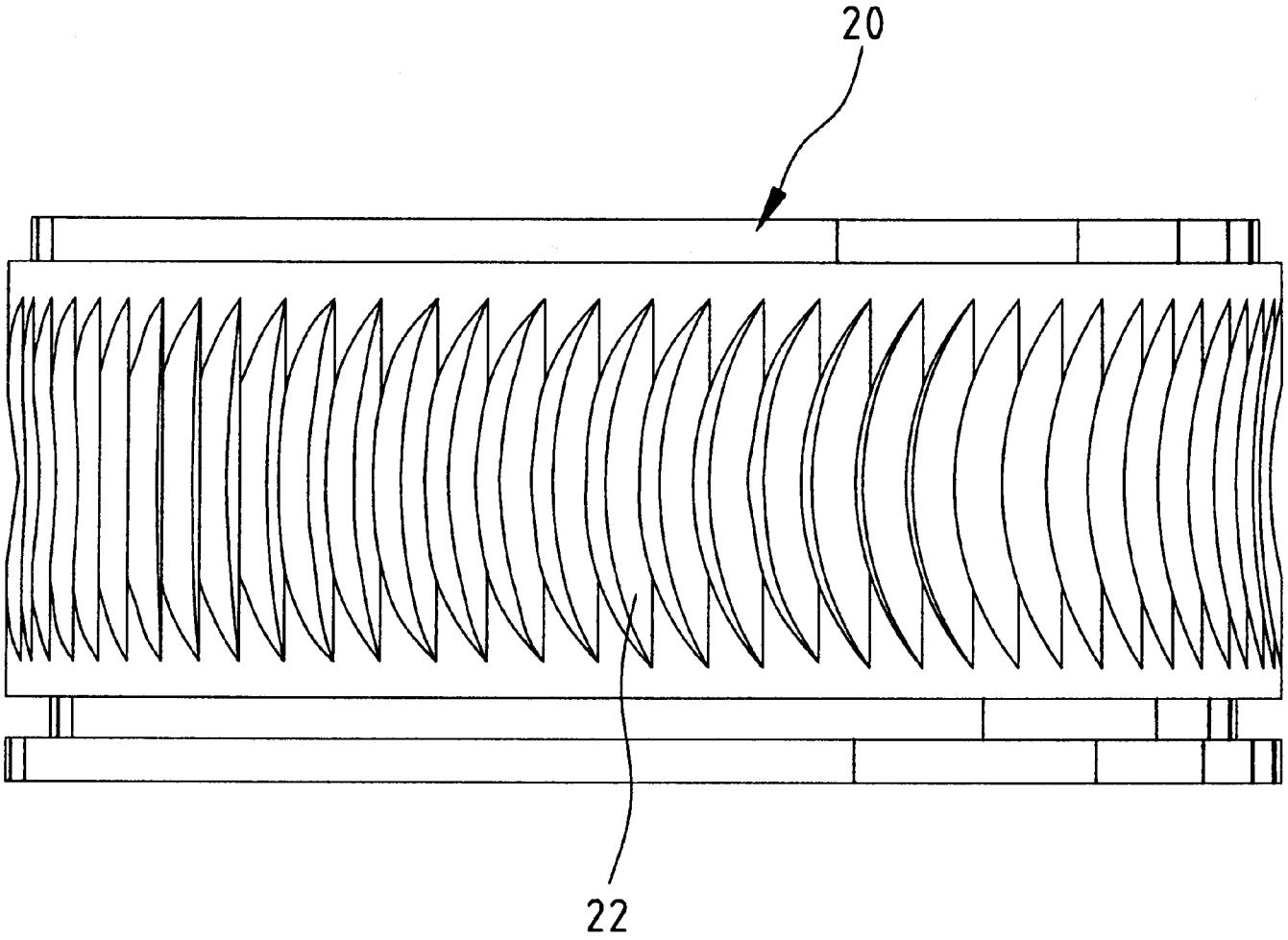
FIG. 2 is a side view of the ratchet wheel in accordance with the present invention.
Figure 3:
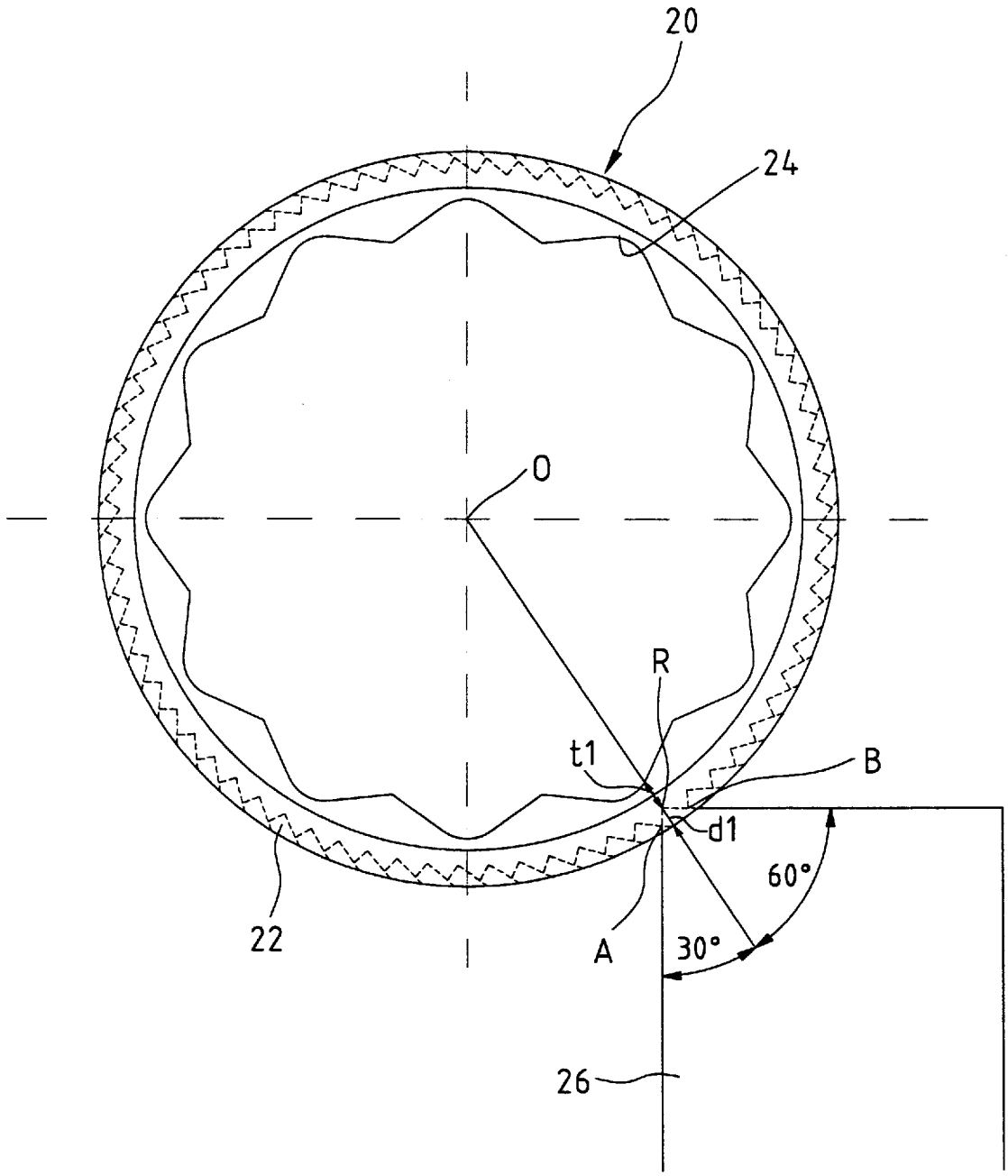
FIG. 3 is a top view of the ratchet wheel in accordance with the present invention, illustrating formation of asymmetric arcuate concave teeth in an outer periphery of the ratchet wheel.

Referring to FIGS. 1 through 9 and initially to FIGS. 1 through 3, a ratchet wheel 20 in accordance with the present invention generally includes an inner periphery 24 for driving a fastener (not shown) and an outer periphery having a plurality of arcuate concave teeth 22. Referring to FIG. 3, each arcuate concave tooth 22 is formed by means of feeding a cutter 26 along a direction transverse to a radial direction (see line OR). The resultant concave tooth 22 has a depth "$d_1$" and two sides RA and RB that intersect at point "R". The line OR divides the angle θ defined by the two sides RA and RB of the concave tooth 22 into two unequal portions (e.g., 30° and 60°, 40° and 50°, etc). Namely, every tooth 22 thus formed is "asymmetric", or the two sides for each teeth 22 is not equal, which is the most important feature of this embodiment of the present invention. As illustrated in FIG. 3, each concave tooth 22 is machined to have a depth "$d_1$" that will not adversely affect the structural strength of the ratchet wheel, as the remaining wall thickness "$t_1$" of the ratchet wheel 20 is still relatively large. As a result, the ratchet wheel 20 may bear a relatively large driving torque for driving the fastener.

Figure 4:
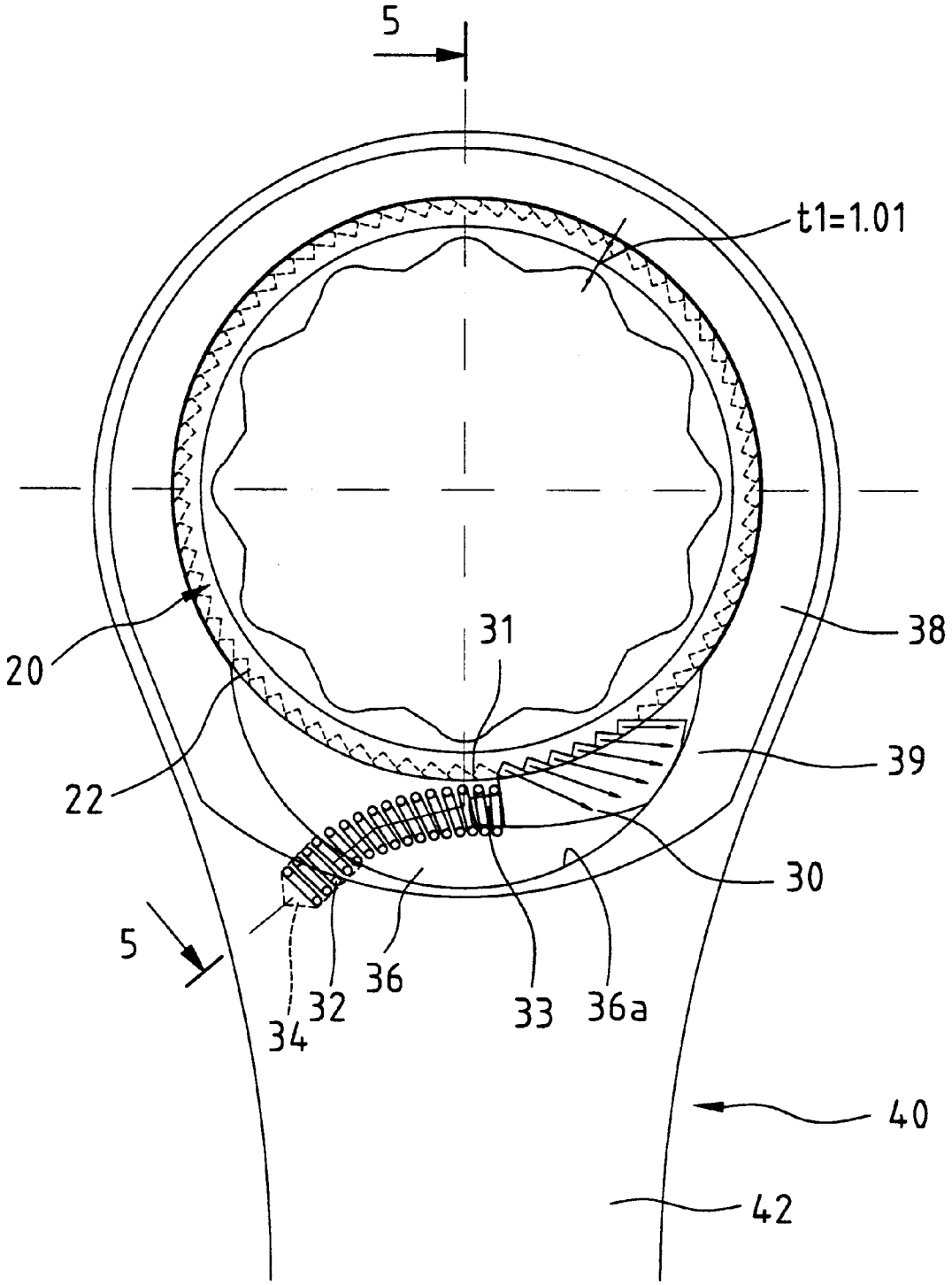
FIG. 4 is a top view of a box end of a ring spanner equipped with the ratchet wheel in accordance with the present invention.
Figure 5:
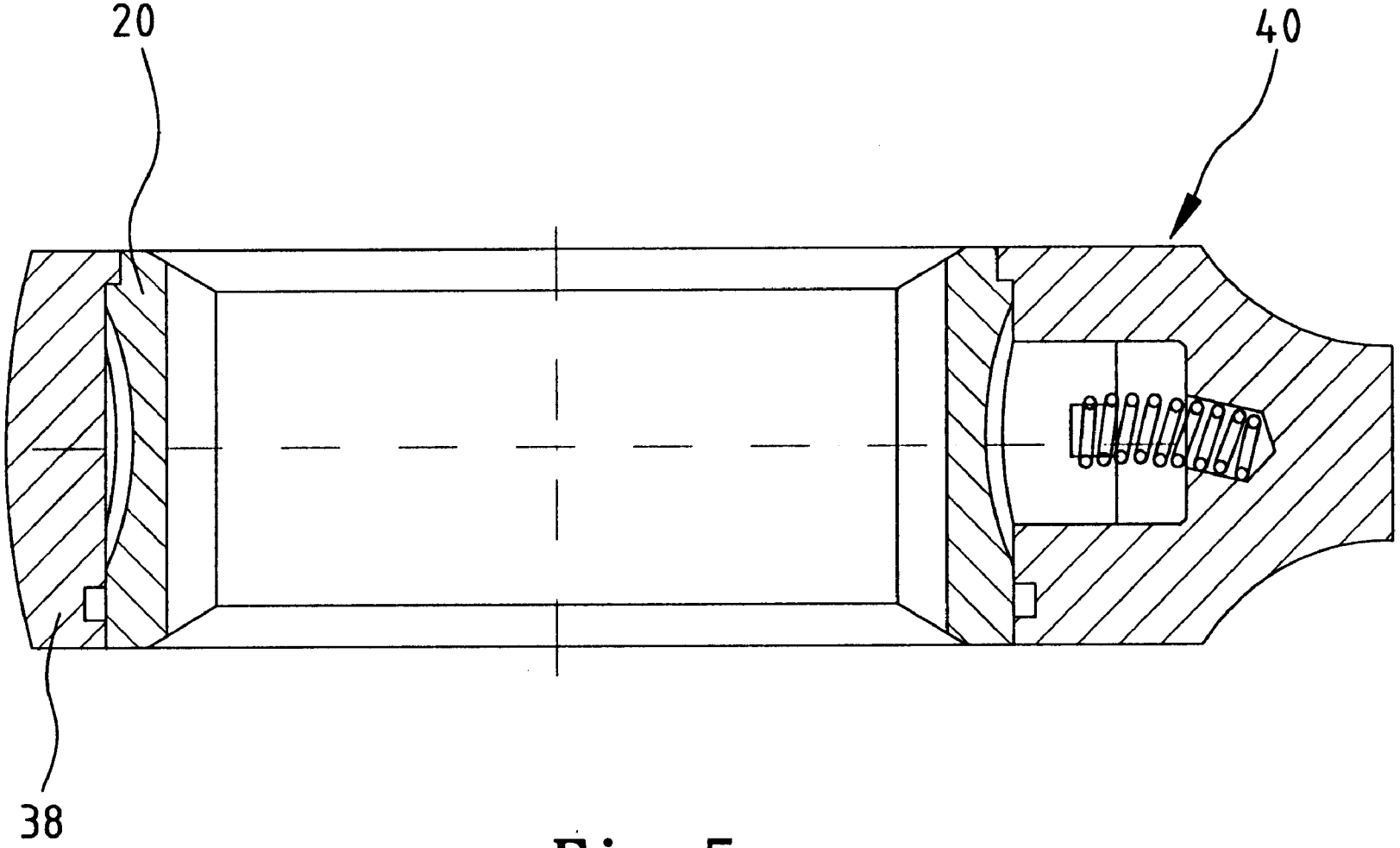
FIG. 5 is a sectional view taken along line 5—5 in FIG. 4.
Figure 6:
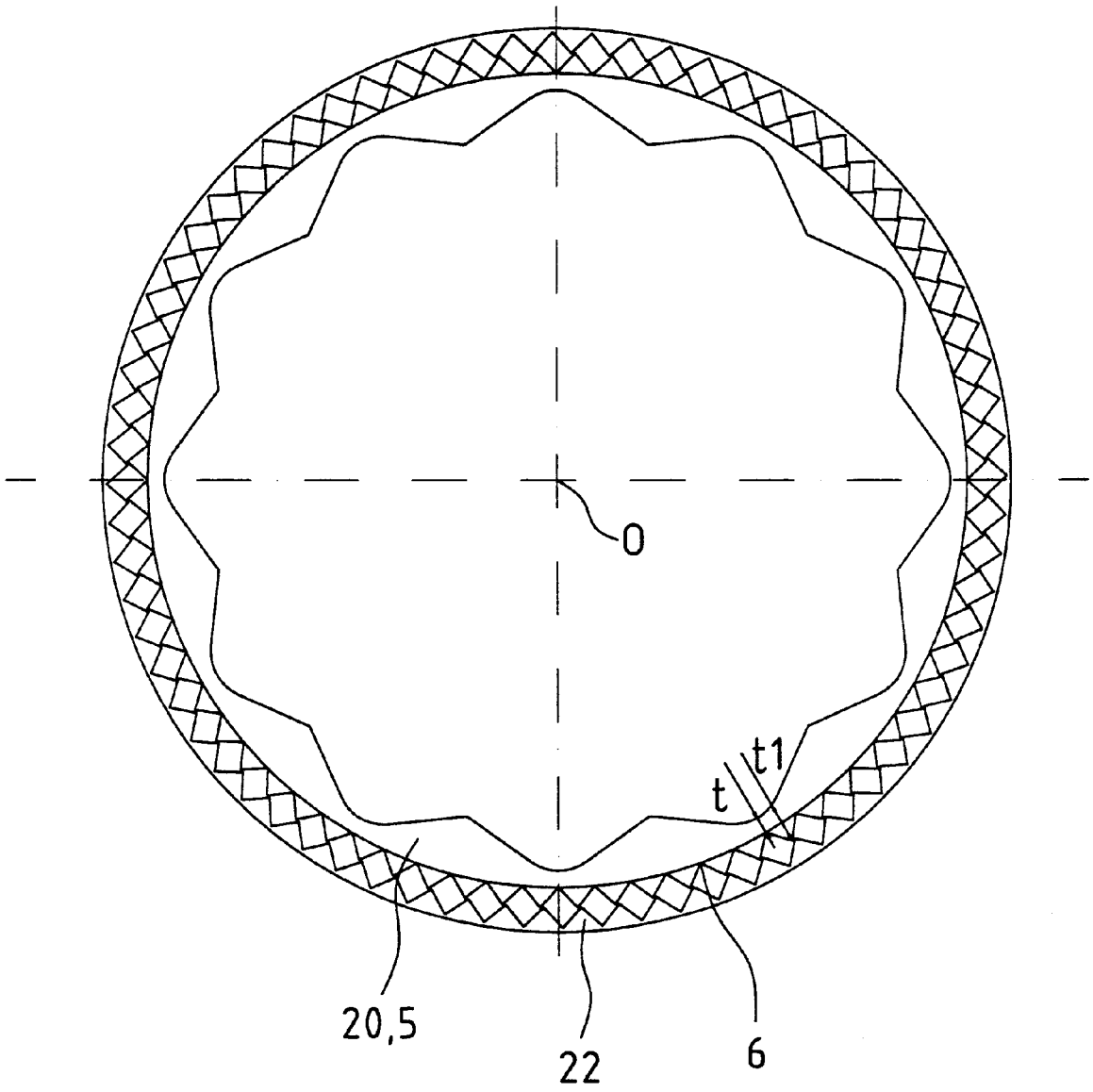
FIG. 6 is a top view, in an enlarged scale, of the ratchet wheel in accordance with the present invention, wherein position of symmetric concave teeth formed according to prior art is illustrated to show difference therebetween.
Figure 14:
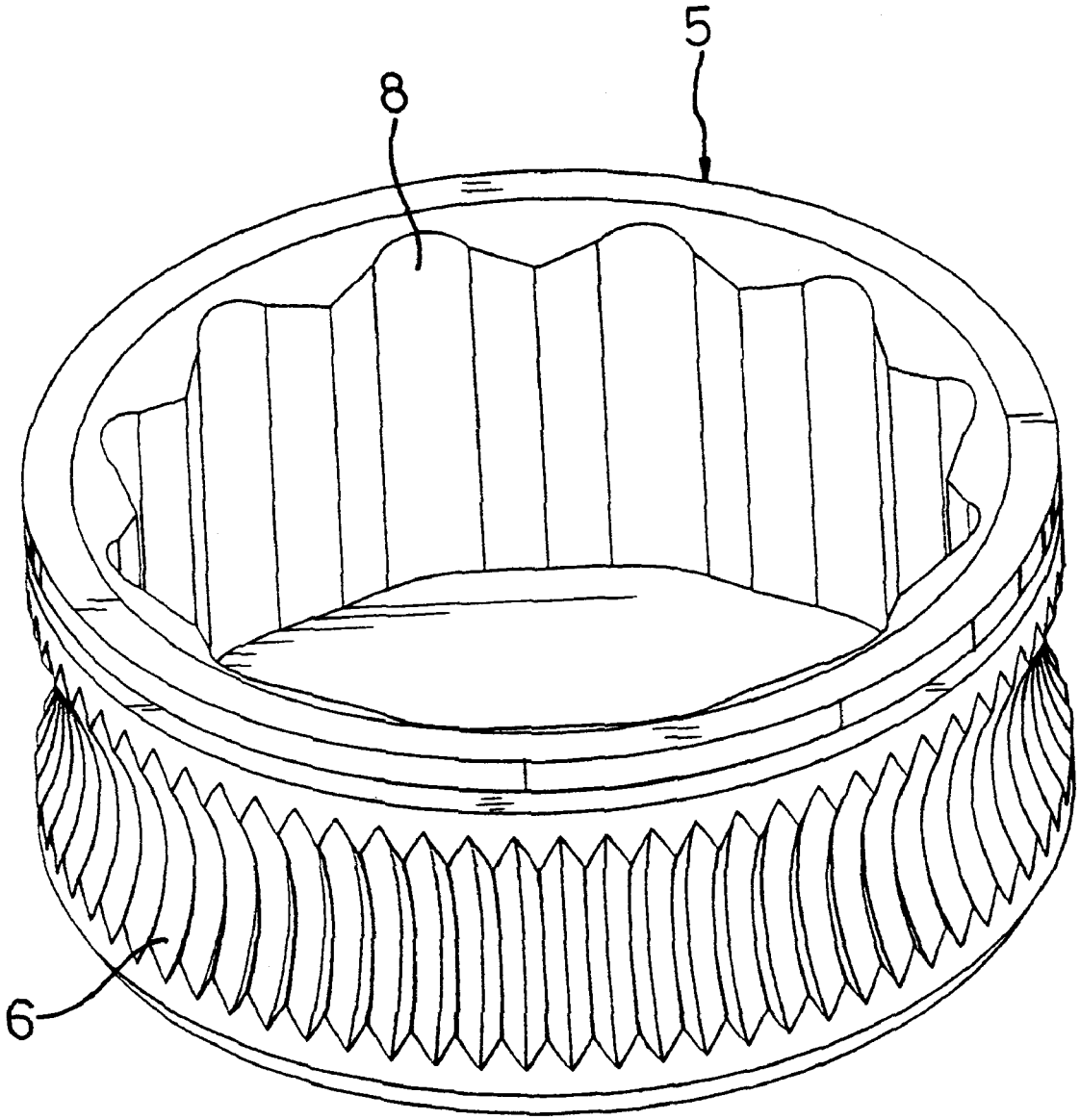
Fig. 14 PRIOR ART
FIG. 14 is a perspective view of another ratchet wheel according to prior art.
Figure 15:
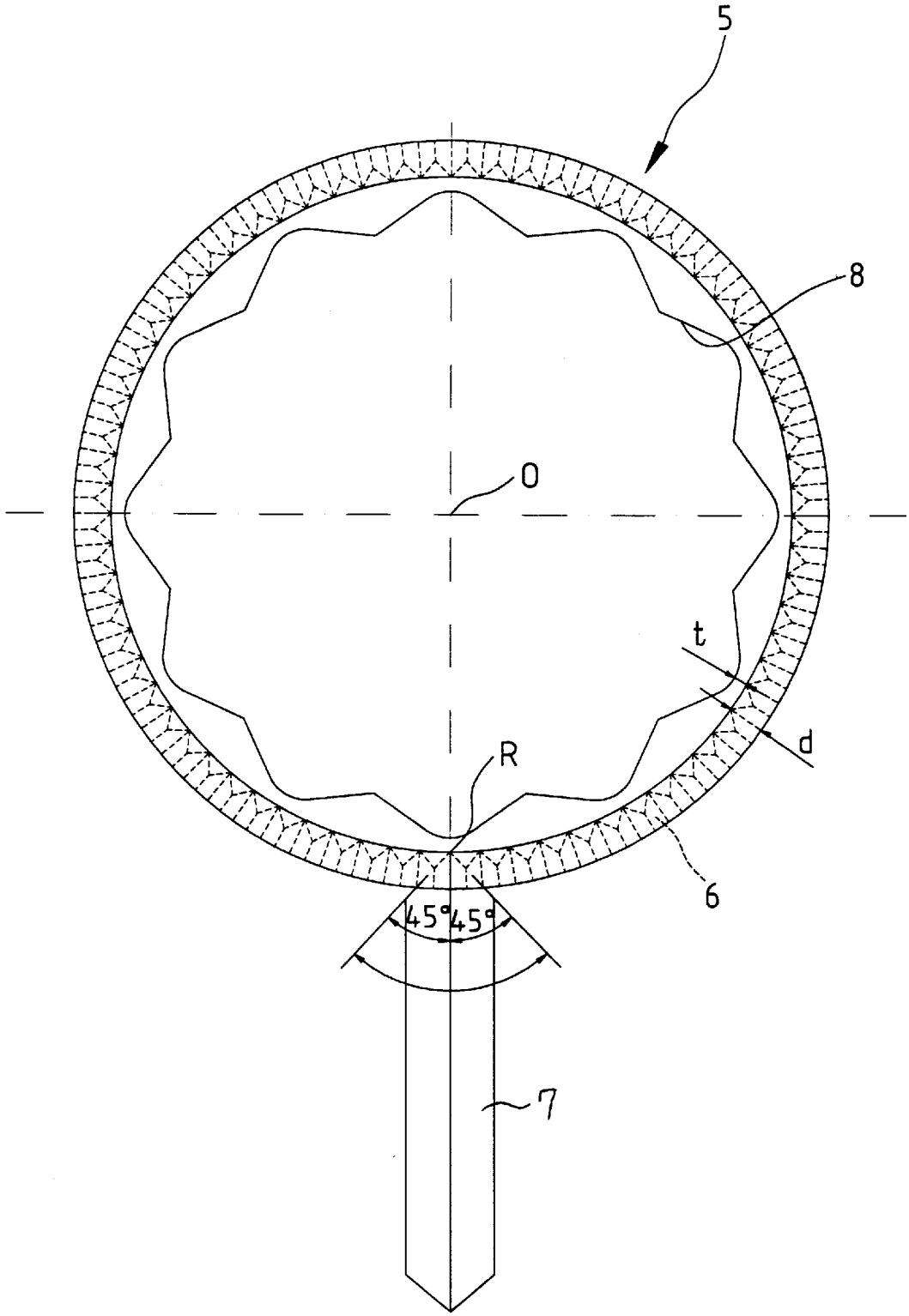
Fig. 15 PRIOR ART
FIG. 15 is a top view of the ratchet wheel in FIG. 14.
Figure 16:
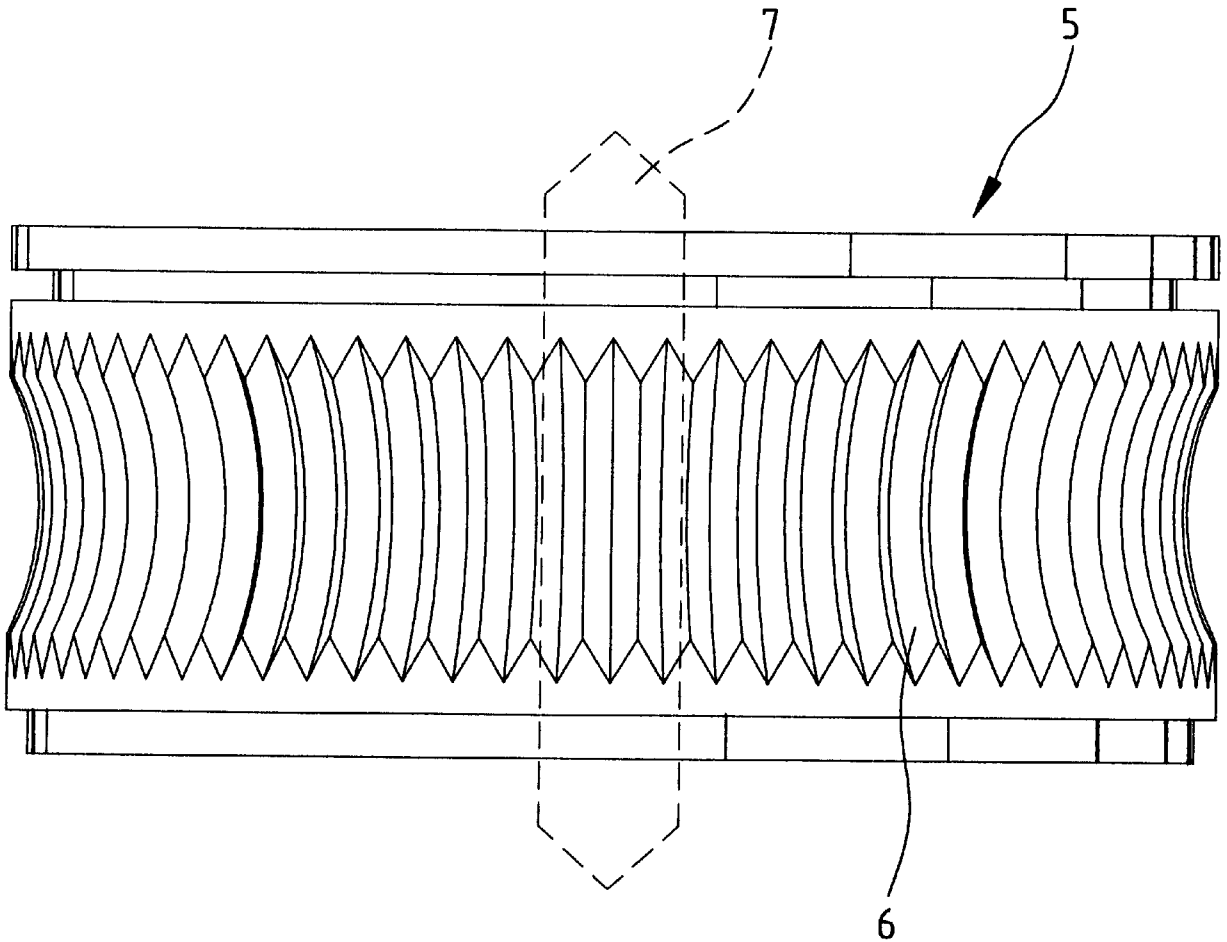
Fig. 16 PRIOR ART
FIG. 16 is a side view of the ratchet wheel in FIG. 14.
Figure 17:
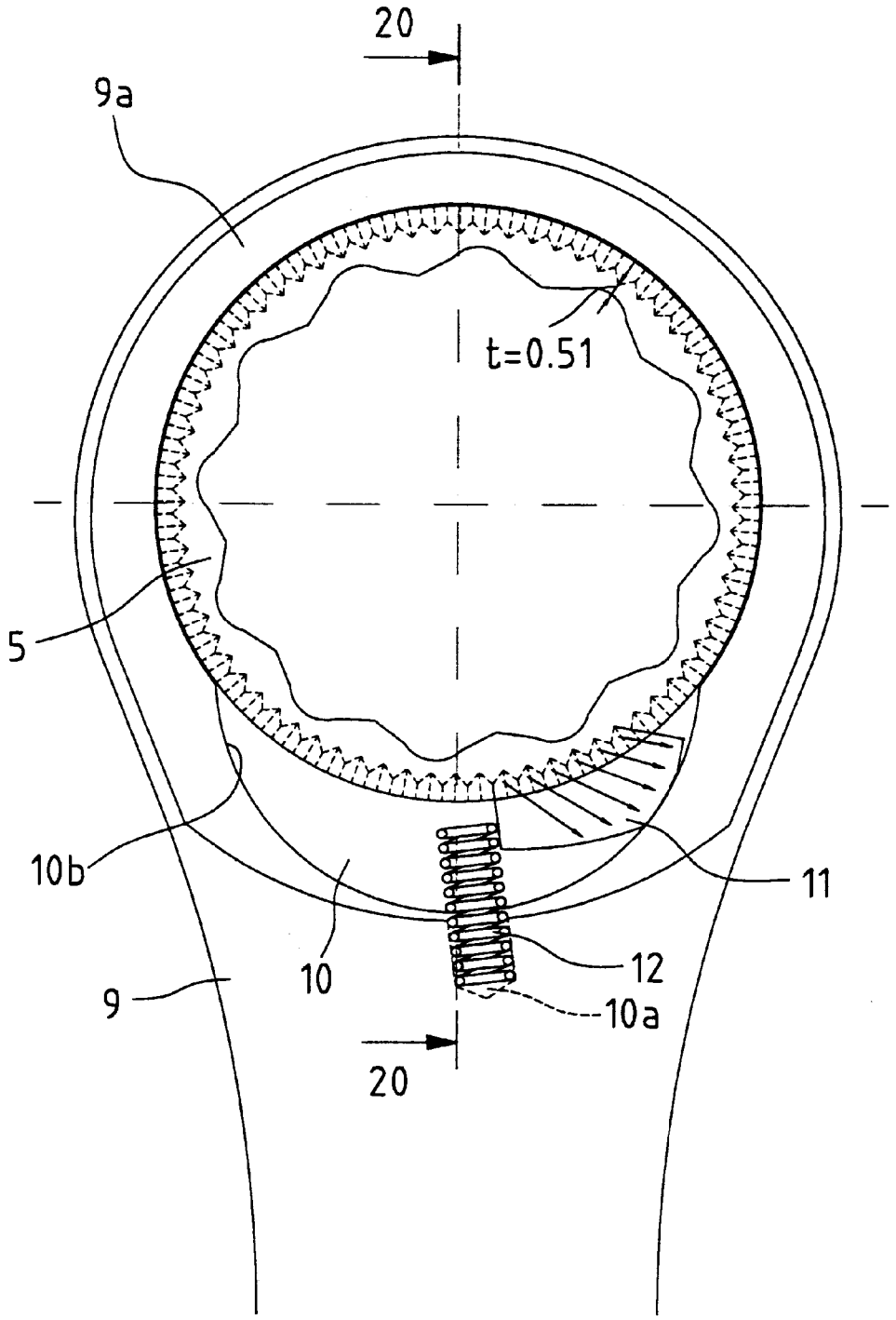
Fig. 17 PRIOR ART
FIG. 17 is a top view of a box end of a ring spanner equipped with the ratchet wheel in FIG. 14.

Difference in the depth of the tooth 22 of the ratchet wheel 20 of the present invention and the depth of the tooth 6 of conventional ratchet wheel 5 (FIG. 14) is illustrated in FIG. 6. Namely, the remaining wall thickness "$t_1$" of the ratchet wheel 20 of the present invention is greater than the remaining wall thickness "t" of conventional ratchet wheel 5 that has the same size as the ratchet wheel 20. Referring to FIGS. 4 and 17, the narrowest wall thickness ($t_1$=1.01 mm in FIG. 4 for a ratchet wheel having an outer diameter of 25.76 mm) of the ratchet wheel 20 of the present invention is almost twice as the narrowest wall thickness (t=0.51 mm in FIG. 17 for a ratchet wheel having an outer diameter of 25.76 mm) of conventional ratchet wheel 5. Thus, the structural strength and the driving torque of the ratchet wheel of the present invention are both improved.

Figure 7A:
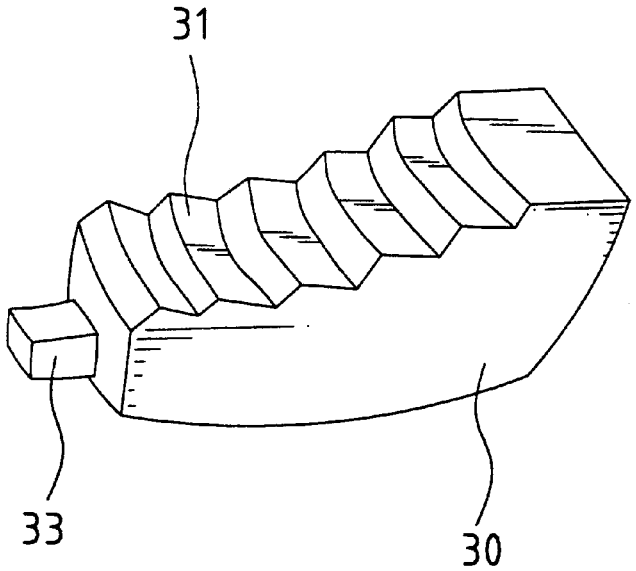
FIG. 7*a* is a perspective view of a pawl for cooperating with the asymmetric arcuate concave teeth of the ratchet wheel in accordance with the present invention.
Figure 7B:
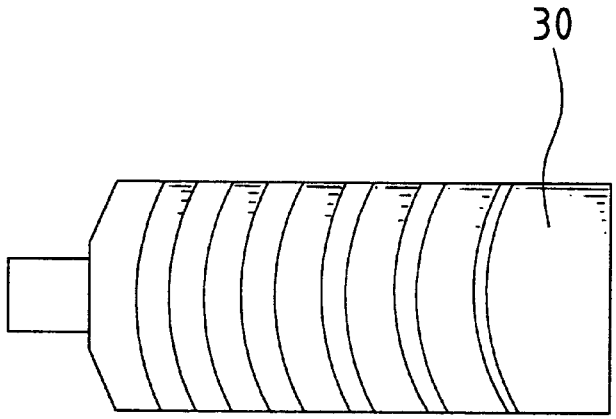
FIG. 7*b* is a top view of the pawl in FIG. 7*a;*
Figure 7C:
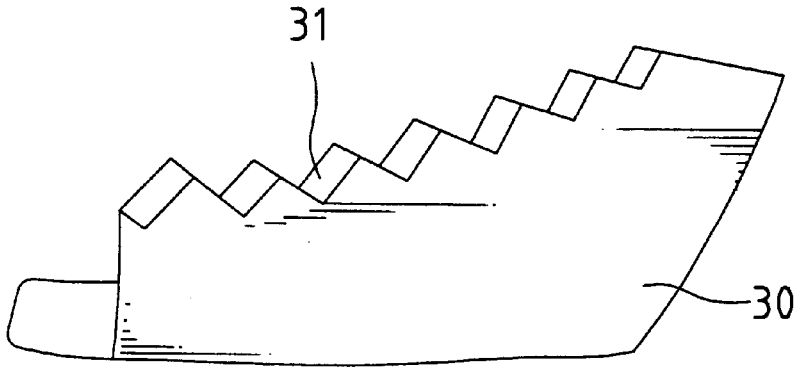
FIG. 7*c* is a side view of the pawl in FIG. 7*a;*
Figure 8A:
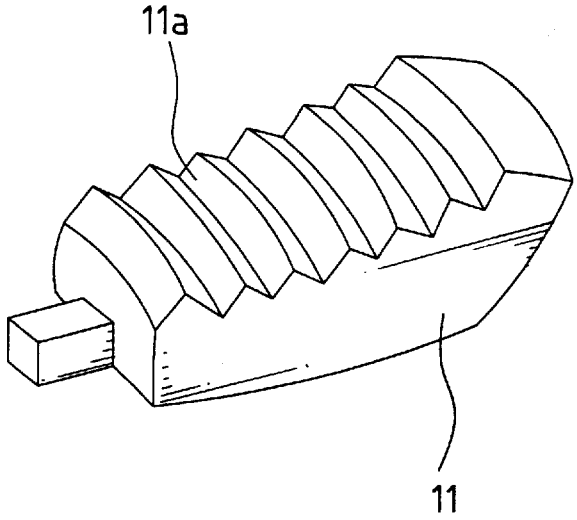
Fig. 8a PRIOR ART
FIG. 8*a* is a perspective view of a conventional pawl for cooperating with the arcuate concave teeth of the ratchet wheel in FIG. 14.
Figure 8B:
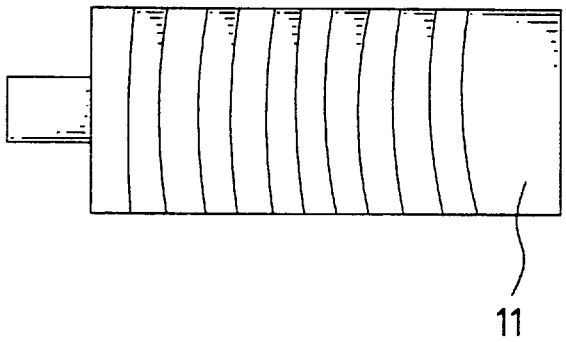
Fig. 8b PRIOR ART
FIG. 8*b* is a top view of the pawl in FIG. 8*a;*
Figure 8C:
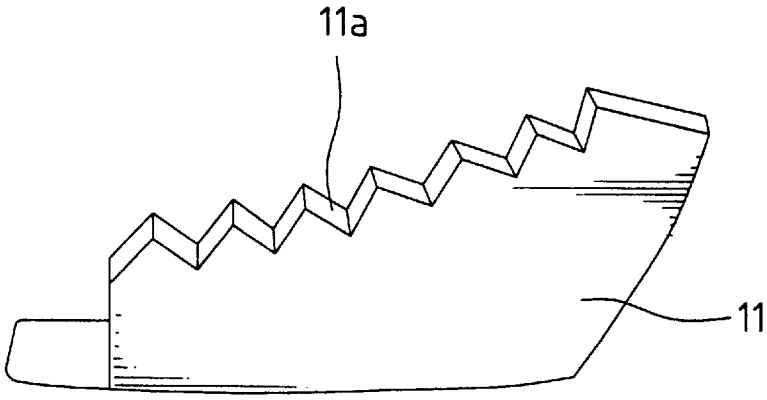
Fig. 8c PRIOR ART
FIG. 8*c* is a side view of the pawl in FIG. 8*a;*
Figure 20:
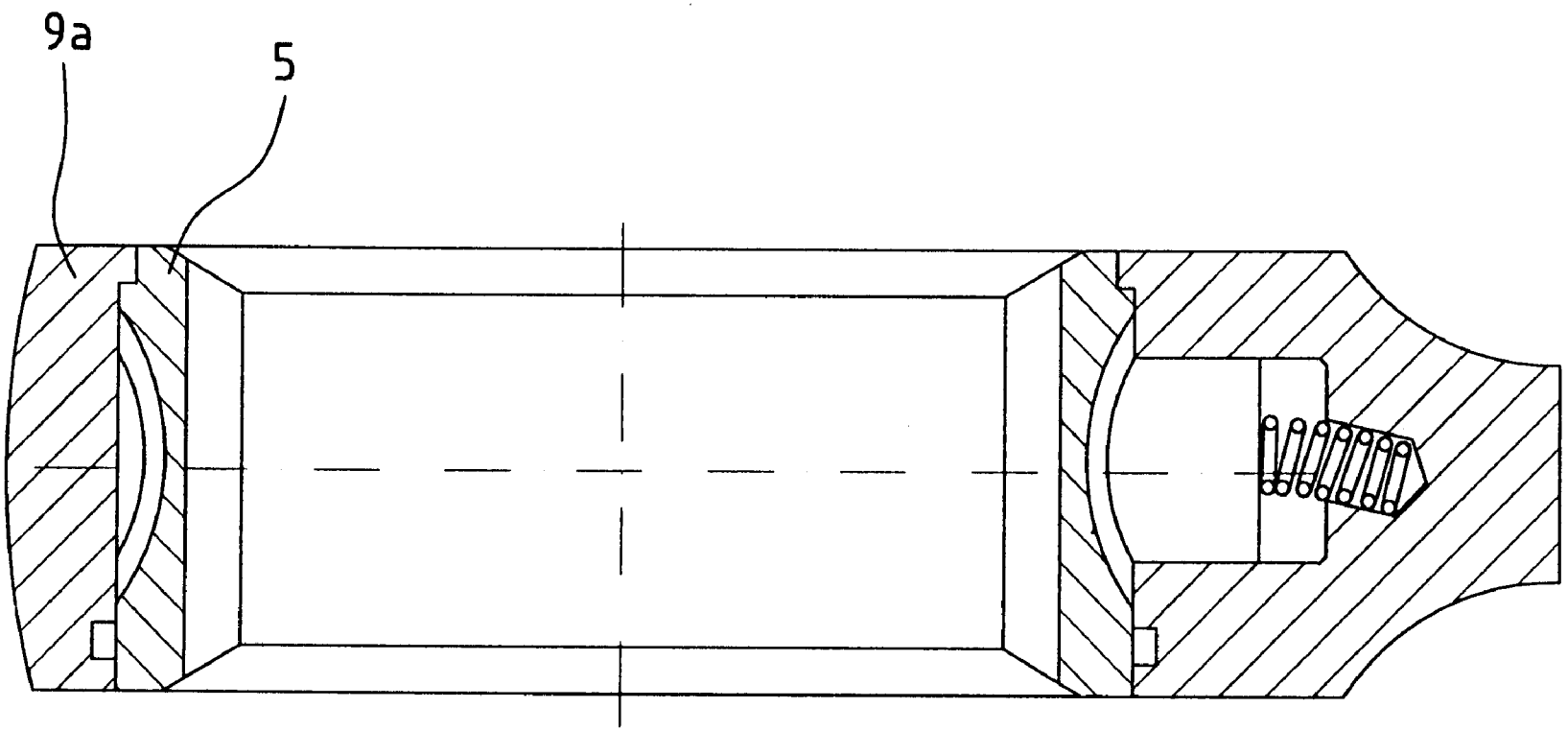
Fig. 20 PRIOR ART
FIG. 20 is a sectional view taken along line 20—20 in FIG. 17.

Referring to FIG. 4, the ratchet wheel 20 in accordance with the present invention is rotatably mounted in a box end 38 of a ring spanner 40. A web area 39 between the box end 38 and a handle 42 of the ring spanner 40 includes a compartment 36 for receiving a pawl 30. FIGS. 7*a* through 7*c* illustrate the pawl 30. The pawl 30 includes a plurality of teeth 31 that are formed complimentary to the curvatures of the asymmetric arcuate concave teeth 22. An end 33 of the pawl 30 is attached to an end of an elastic member 32 the other end of which is received in a cavity 34 defined in a wall 36*a* defining the compartment 36, best shown in FIG. 4. FIG. 17 illustrates a conventional arrangement of a ratchet type ring spanner 9 that has a box end 9*a* for rotatably receiving the ratchet wheel 5. A web area (not labeled) of the ring spanner 9 includes a compartment 10 for receiving a pawl 11. FIGS. 8*a* through 8*c* illustrate the pawl 11. The pawl 11 includes a plurality of teeth 11*a* that are formed complimentary to the curvatures of the symmetric arcuate concave teeth 6. An end (not labeled) of the pawl 11 is attached to an end of an elastic member 12 the other end of which is received in a cavity 10*a* defined in a wall 10*b* defining the compartment 10, best shown in FIG. 17. FIGS. 8*a*, 8*b*, 8*c*, and 17 are illustrated for comparison purpose. In addition, difference in the wall thickness of the ratchet wheel 20 of the present invention and the wall thickness of conventional ratchet wheel 5 can also be clearly seen in FIG. 6 and by means of comparing FIG. 5 with FIG. 20.

Figure 9:
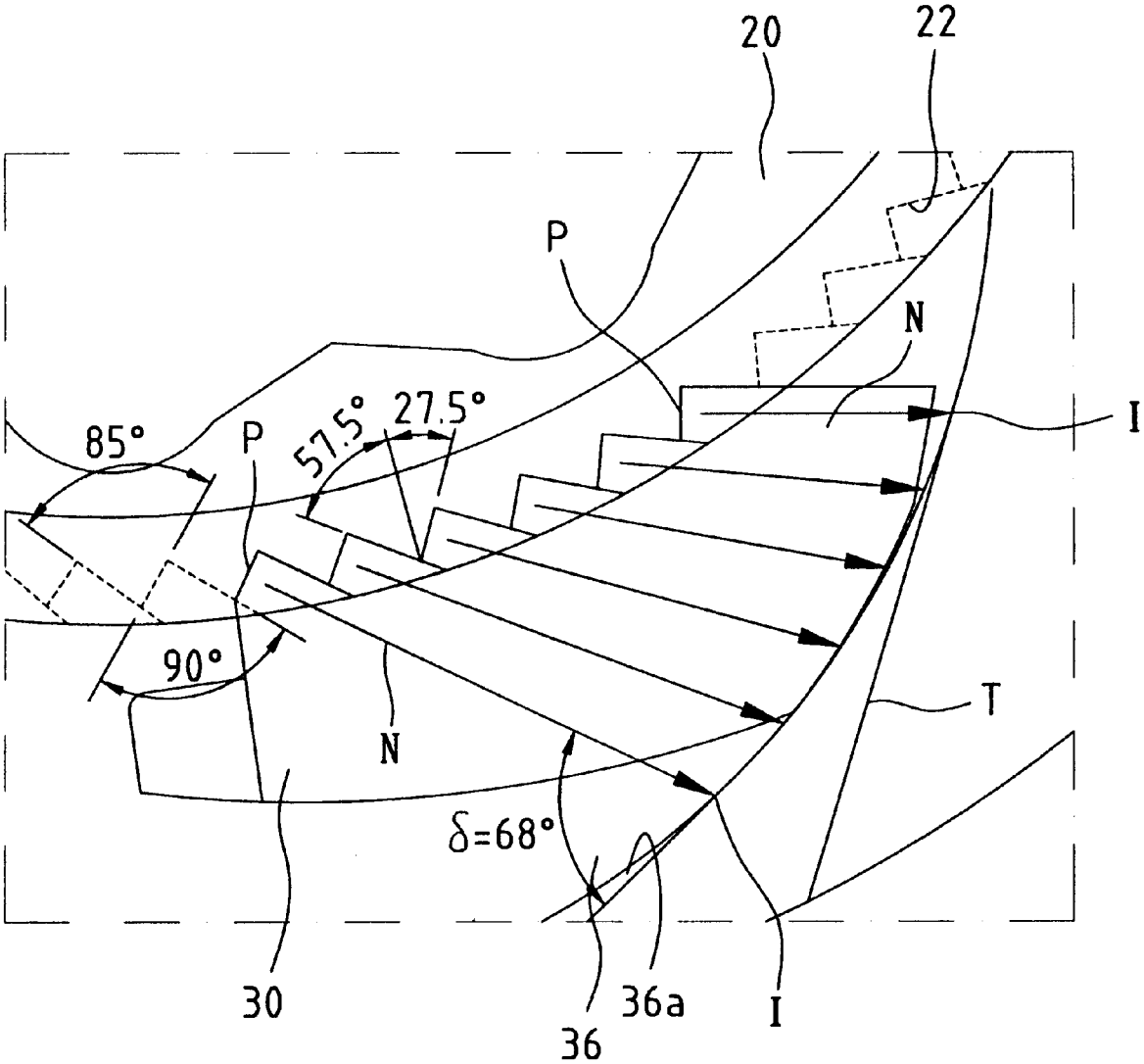
FIG. 9 is an enlarged fragmentary view illustrating operation of the pawl and the asymmetric arcuate concave teeth of the ratchet wheel in accordance with the present invention.
Figure 18:
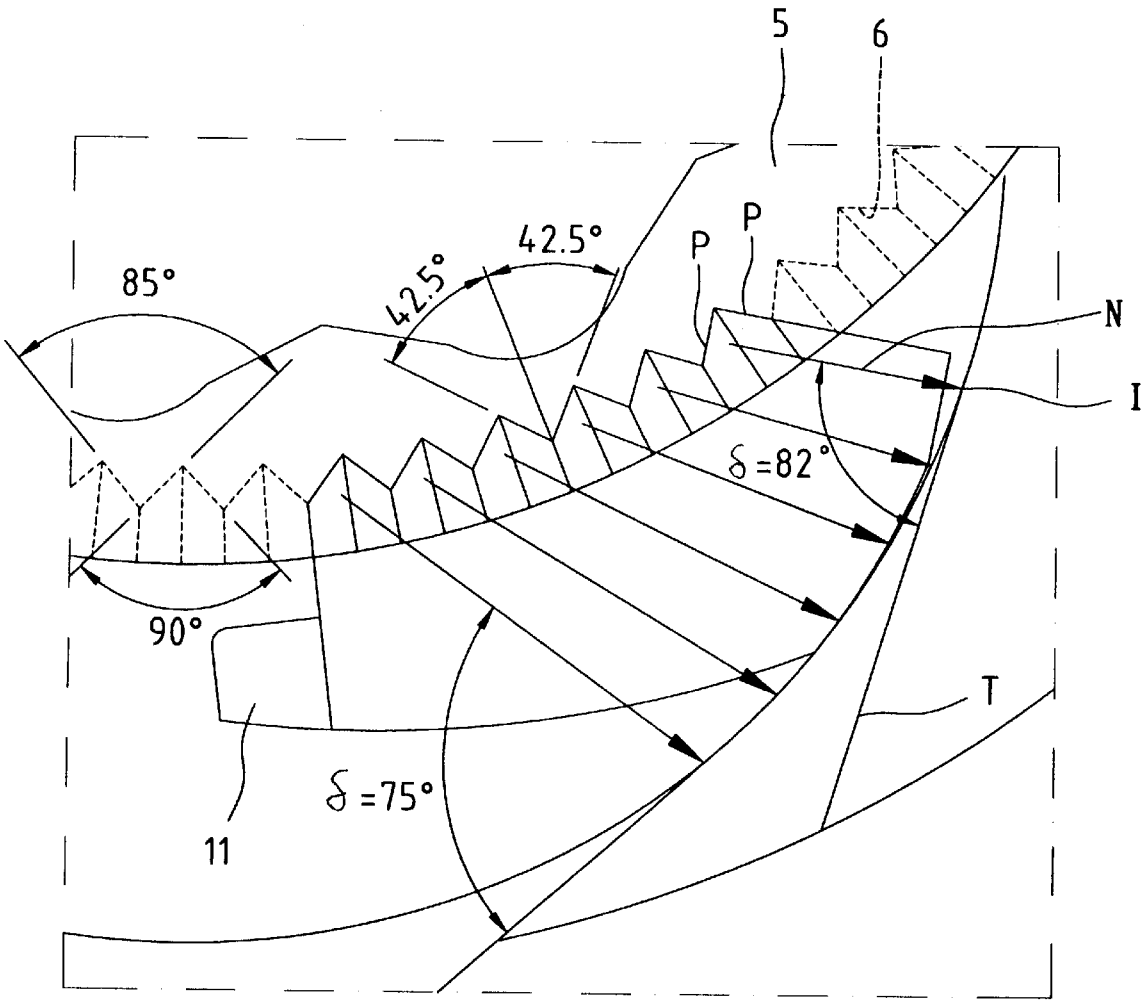
Fig. 18 PRIOR ART
FIG. 18 is an enlarged fragmentary view illustrating operation of the conventional pawl and the symmetric arcuate concave teeth of the conventional ratchet wheel in the ring spanner FIG. 17.

In use of the ring spanner equipped with the ratchet wheel 20 in accordance with the present invention, referring to FIG. 9, the angle δ between a force N normal to the operative side P and the tangent T to the intersection I between the pawl 30 and the wall 36*a* defining the compartment 36 is smaller than that in the prior art ratchet wheel (see FIG. 18). As a result, the pawl 30 in FIG. 9 is reliably pushed toward the wall 36*a* defining the compartment 36 and thus provides a reliable engagement between the teeth 22 of the ratchet wheel 20 and the teeth 31 of the pawl 30. If the angle δ reaches 90°, the pawl moves toward the central area of the ratchet wheel and thus results in an undesired "sliding" effect, as there is no horizontal force imparted to move the pawl toward the wall 36*a* of the compartment 36. Thus, the ratchet wheel 20 and the pawl 30 in accordance with the present invention provides an engagement reliable than that between the conventional ratchet wheel 5 and the pawl 11 and thus less likely to "slide". The spanner with the ratchet wheel/pawl combination in accordance with the present invention can be used in a relatively small space and can be operated in a convenient manner. More specifically, the spanner is allowed to rotate in a reverse direction without disengaging the box end from the fastener when the spanner is stopped by an obstacle during ratcheting. And the spanner is then ready for next ratcheting movement. This is very convenient and timesaving.

Figure 10:
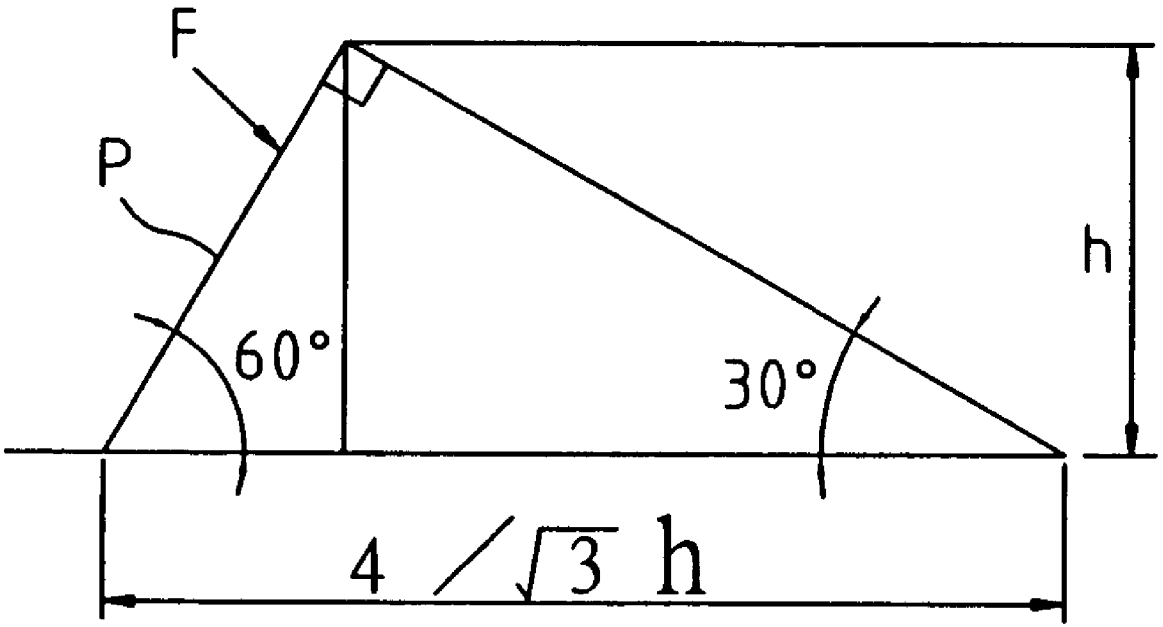
FIG. 10 is a schematic force diagram of the asymmetric arcuate concave tooth of the ratchet wheel in accordance with the present invention.
Figure 11:
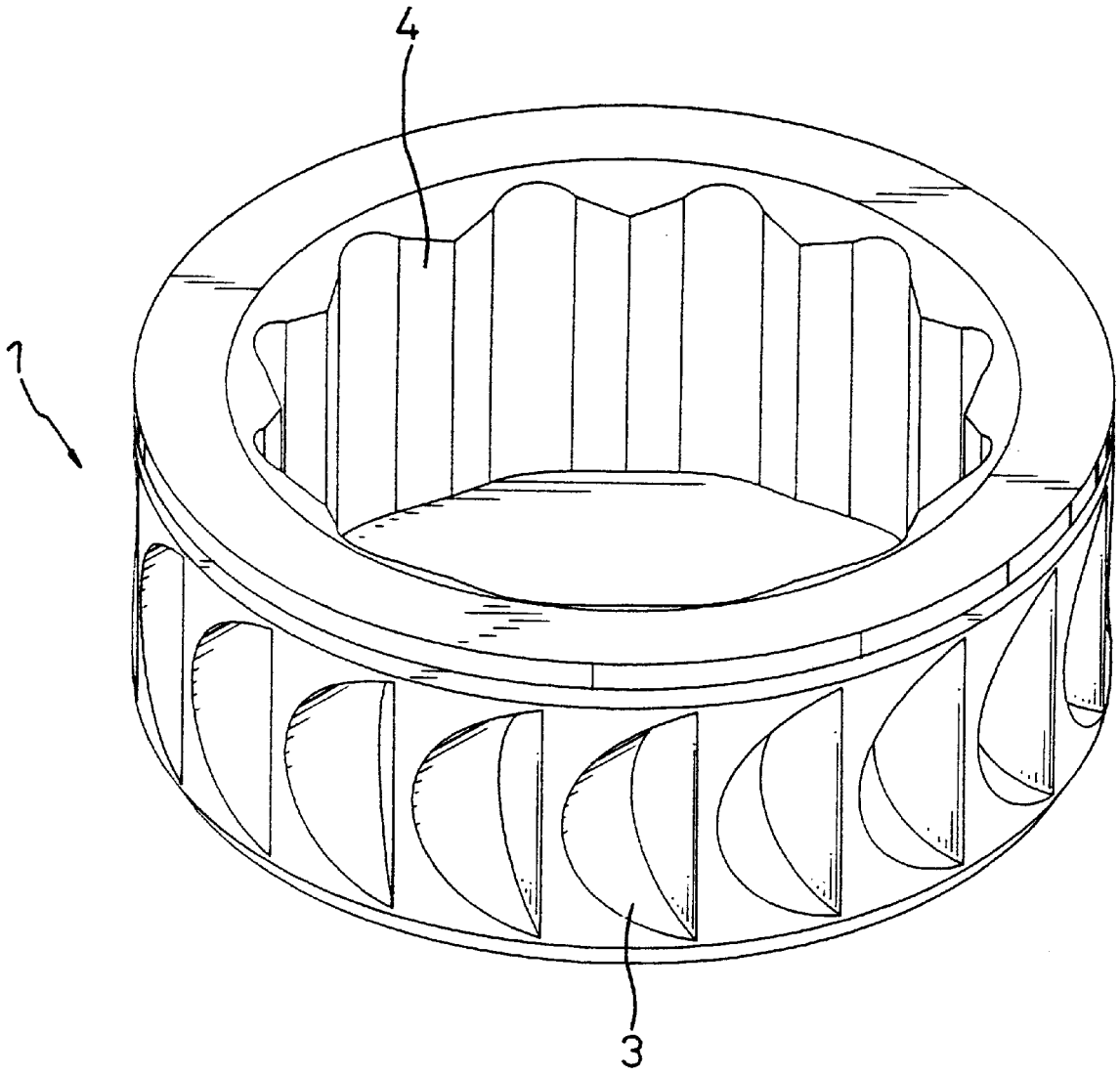
Fig. 11 PRIOR ART
FIG. 11 is a perspective view of a ratchet wheel according to prior art.
Figure 12:
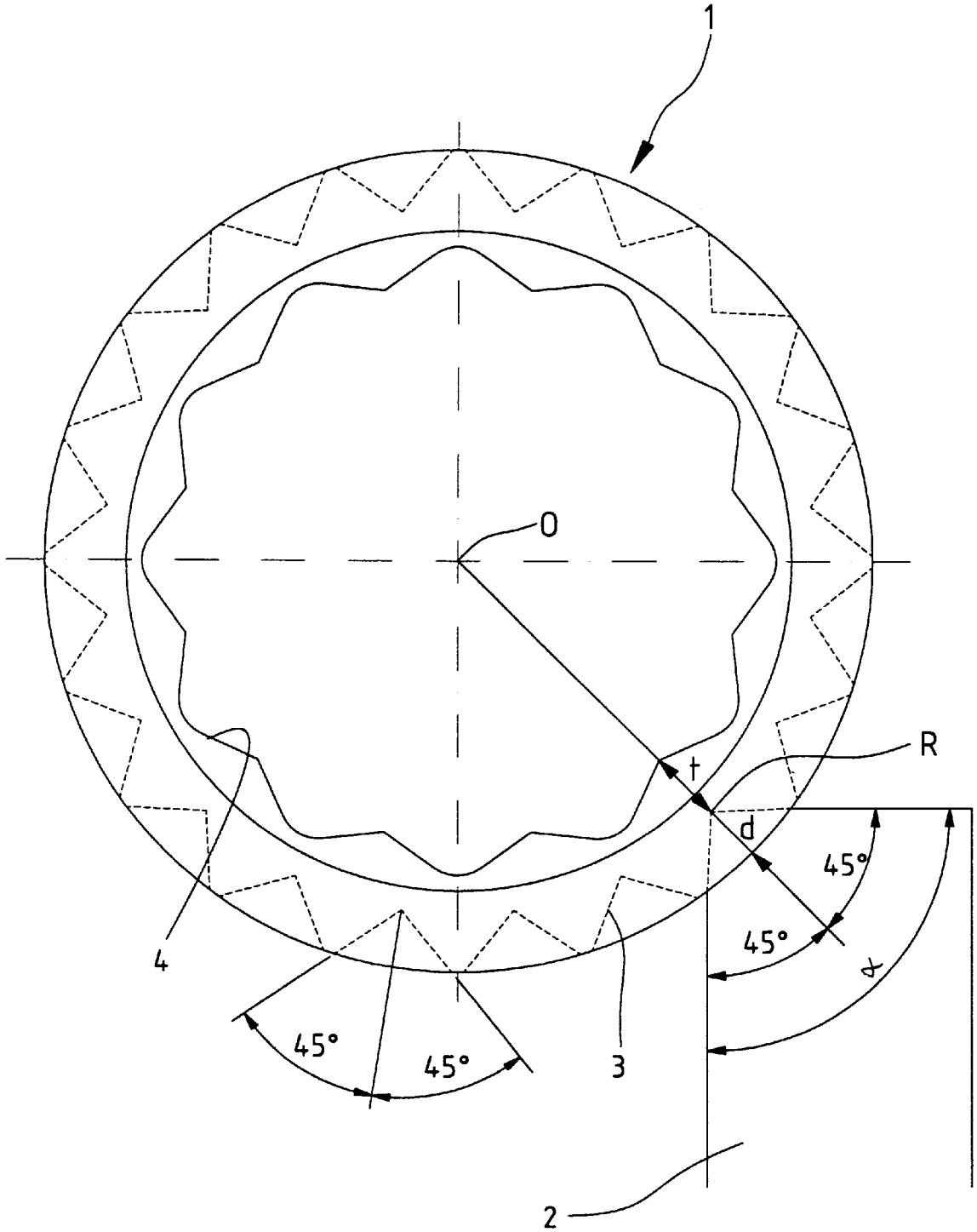
Fig. 12 PRIOR ART
FIG. 12 is a top view of the ratchet wheel in FIG. 11.
Figure 13:
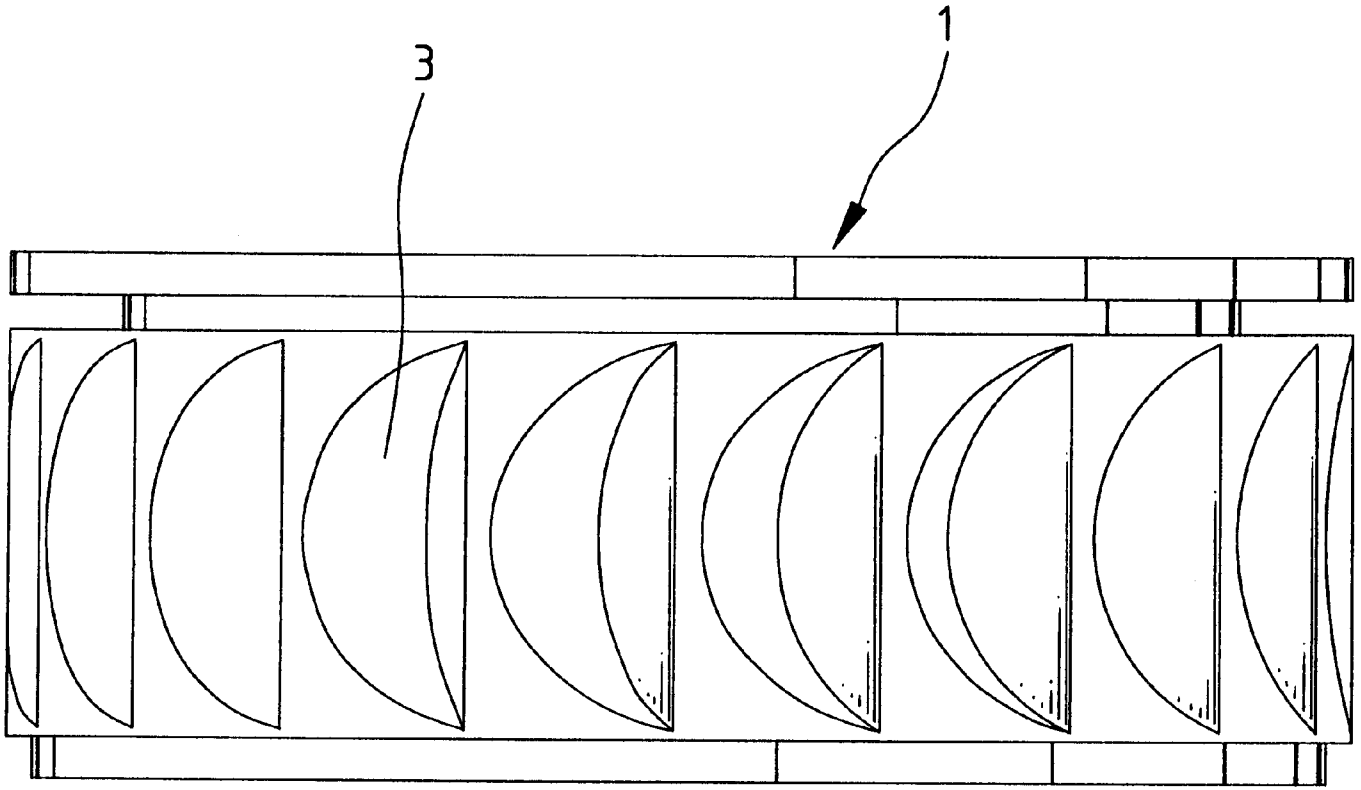
Fig. 13 PRIOR ART
FIG. 13 is a side view of the ratchet wheel in FIG. 11.
Figure 19:
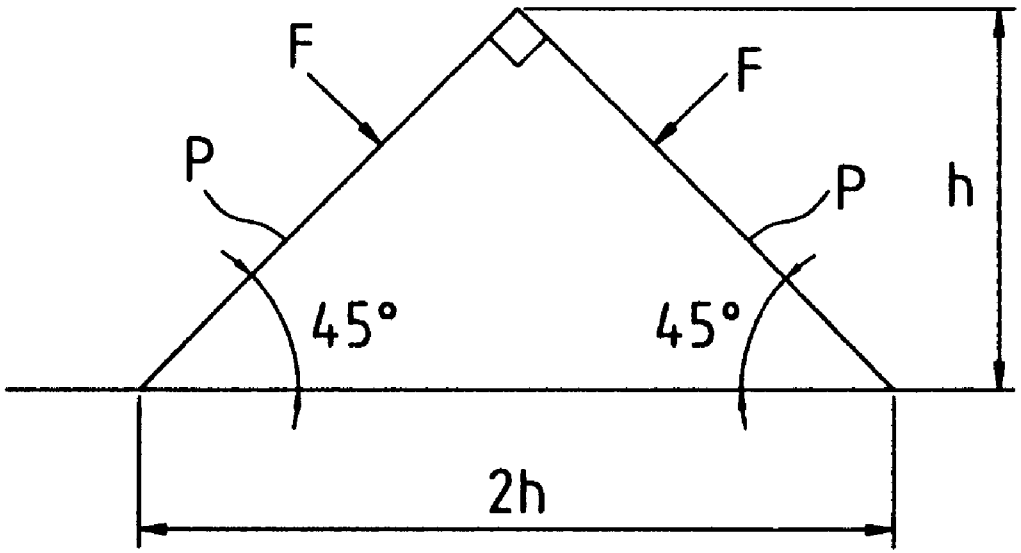
Fig. 19 PRIOR ART
FIG. 19 is a schematic force diagram of the ratchet wheel in FIG. 14.

Referring to FIGS. 9 and 10, when the operative side P of the tooth 22 of the ratchet wheel 20 in accordance with the present invention is subjected to a force F during ratcheting, the area filled by the pawl 30 for bearing such force F is $2/1.732\ h^2$. Referring to FIG. 19, for a conventional ratchet wheel 5, when either operative side P of the tooth 6 of the ratchet wheel 5 is subjected to a force F, the area filled by the pawl 11 for bearing such force F is $h^2$ which is smaller than that provided by the ratchet wheel/pawl combination in accordance with the present invention. Namely, the ratchet wheel 20 with asymmetric arcuate concave teeth 22 provides a higher torque for ratcheting (i.e., tightening or loosening a fastener such as a nut or bolt head).

Figure 21:
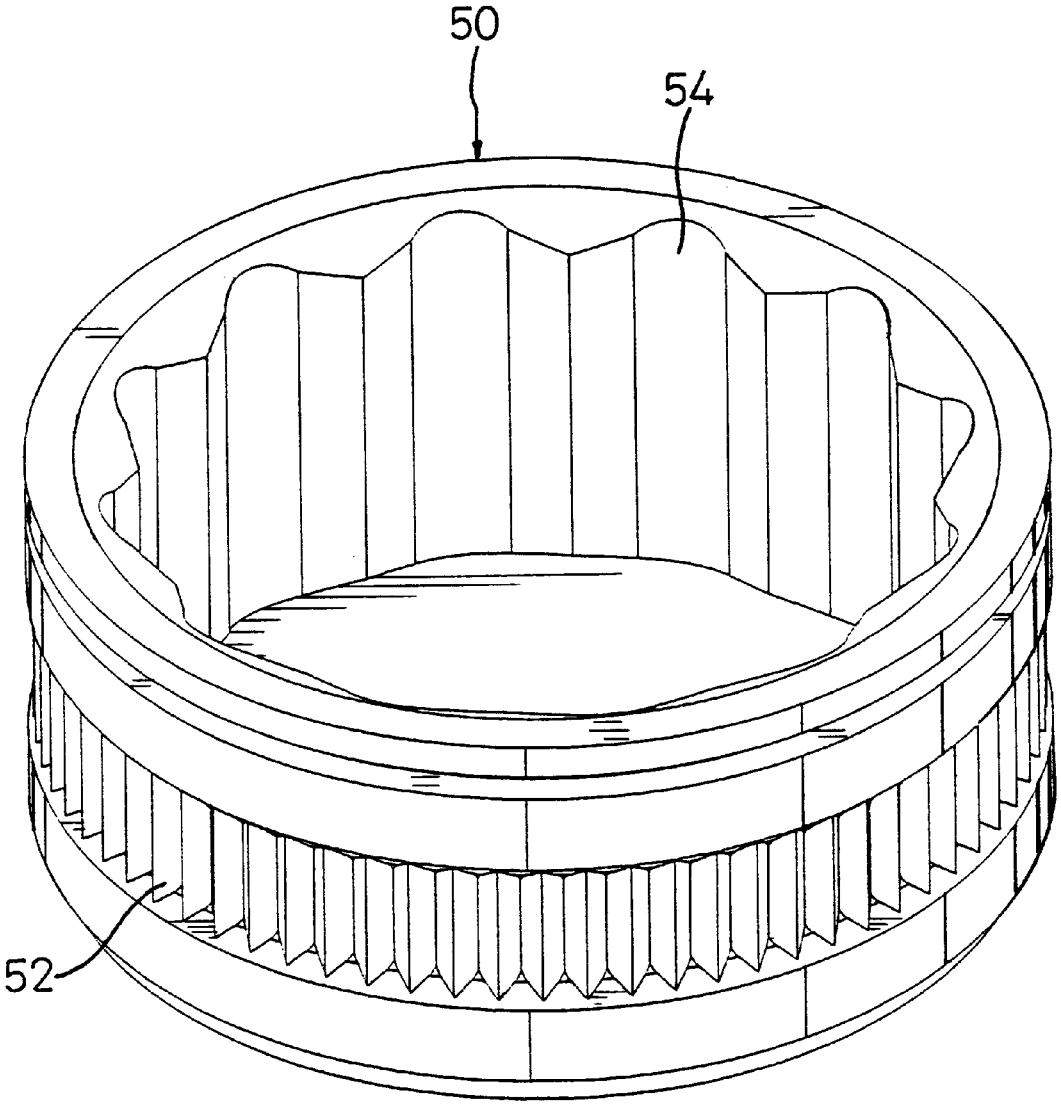
FIG. 21 is a perspective view of a ratchet wheel with non-arcuate concave teeth in accordance with the present invention.
Figure 22:
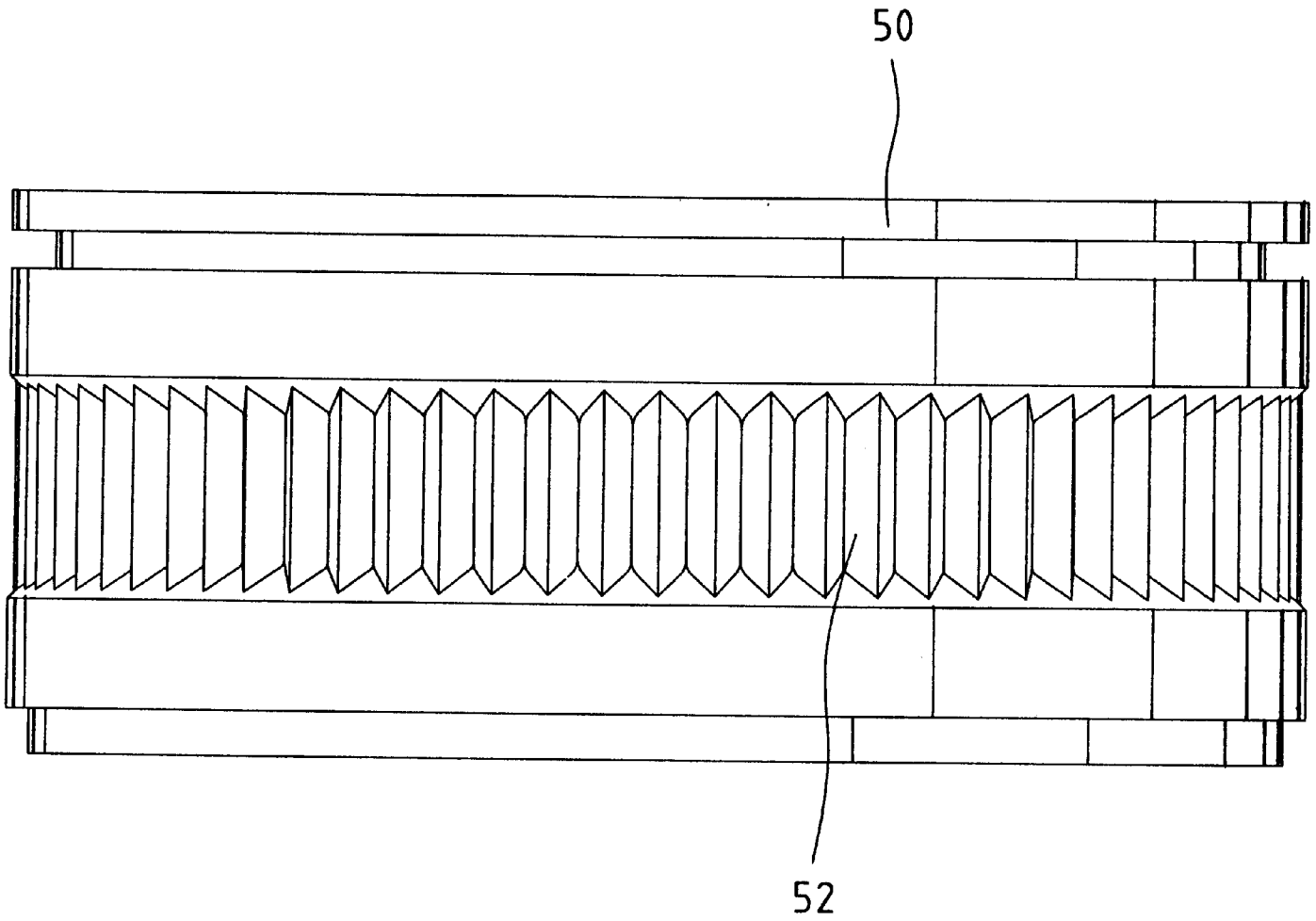
FIG. 22 is a side view of the ratchet wheel in FIG. 21.

Referring to FIGS. 21 and 22, in a second embodiment of the ratchet wheel in accordance with the present invention, the ratchet wheel (now designated by 50) includes an inner periphery 54 for driving a fastener (not shown) and an outer periphery having a plurality of non-arcuate concave teeth 52. The non-arcuate concave teeth 52 is formed by means of roll squeezing method, investment casting, or molding, which is quicker than formation by cutter. Each non-arcuate concave tooth 52 may be trapezoidal, triangular, or any other shape that results from formation other than cutting. The production cost for the ratchet wheel 50 with non-arcuate concave teeth 52 in accordance with the present invention is largely reduced, as the production time for the non-arcuate concave teeth 52 is relatively short. In addition, the non-arcuate concave teeth 52 may be symmetric or asymmetric. When the ratchet wheel 50 has non-arcuate symmetric concave teeth 52, the resultant structure provides a driving torque approximately the same as that provided by the conventional ratchet wheel 5 with symmetric arcuate concave teeth 6. When the ratchet wheel 50 has non-arcuate asymmetric concave teeth 52 configured similar to teeth 22, the resultant structure provides a higher driving torque than that provided by the conventional ratchet wheel 5 with symmetric arcuate concave teeth 6.

Figure 23:
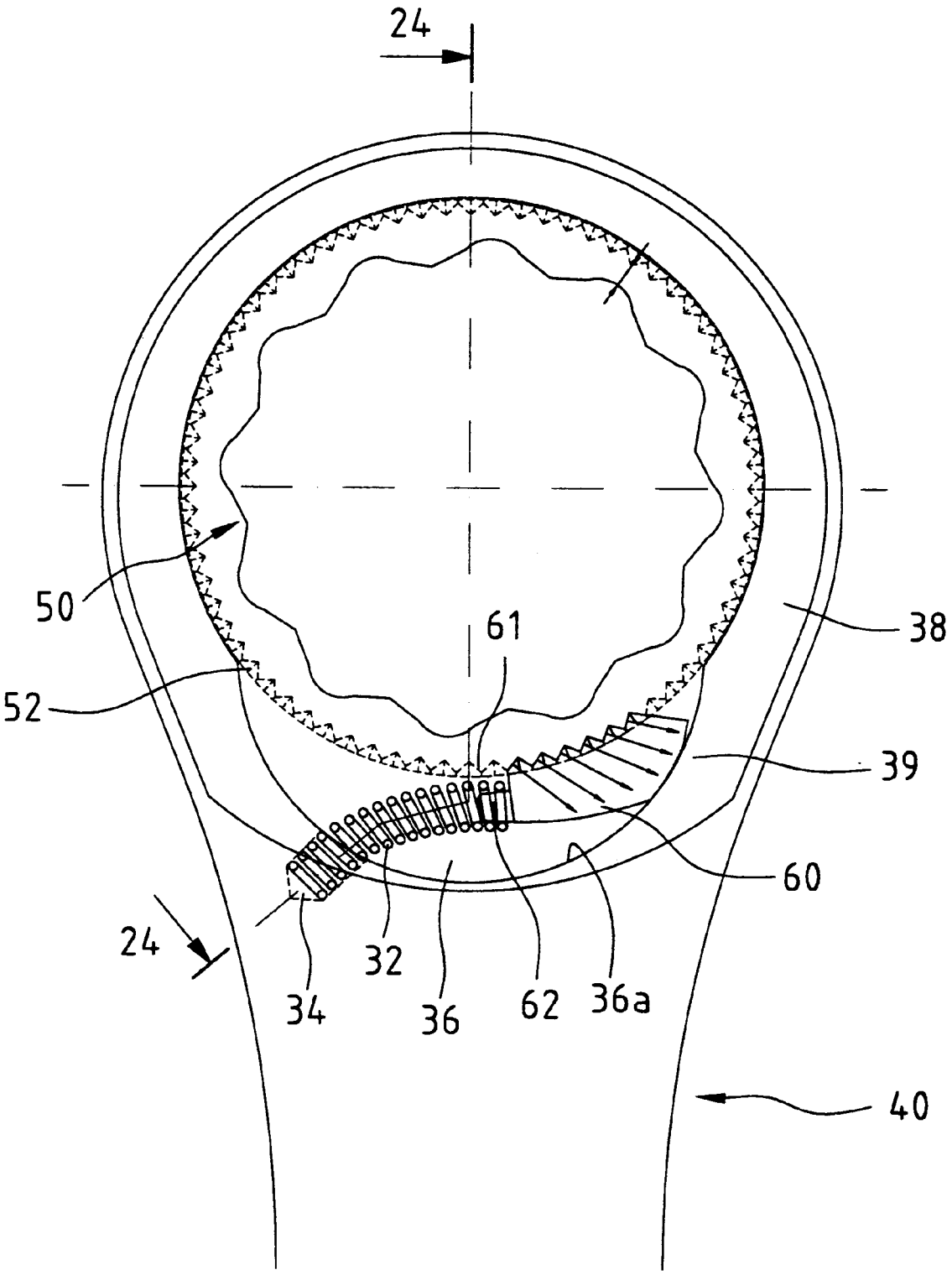
FIG. 23 is a top view of a box end of a ring spanner equipped with the ratchet wheel in FIG. 21.
Figure 24:
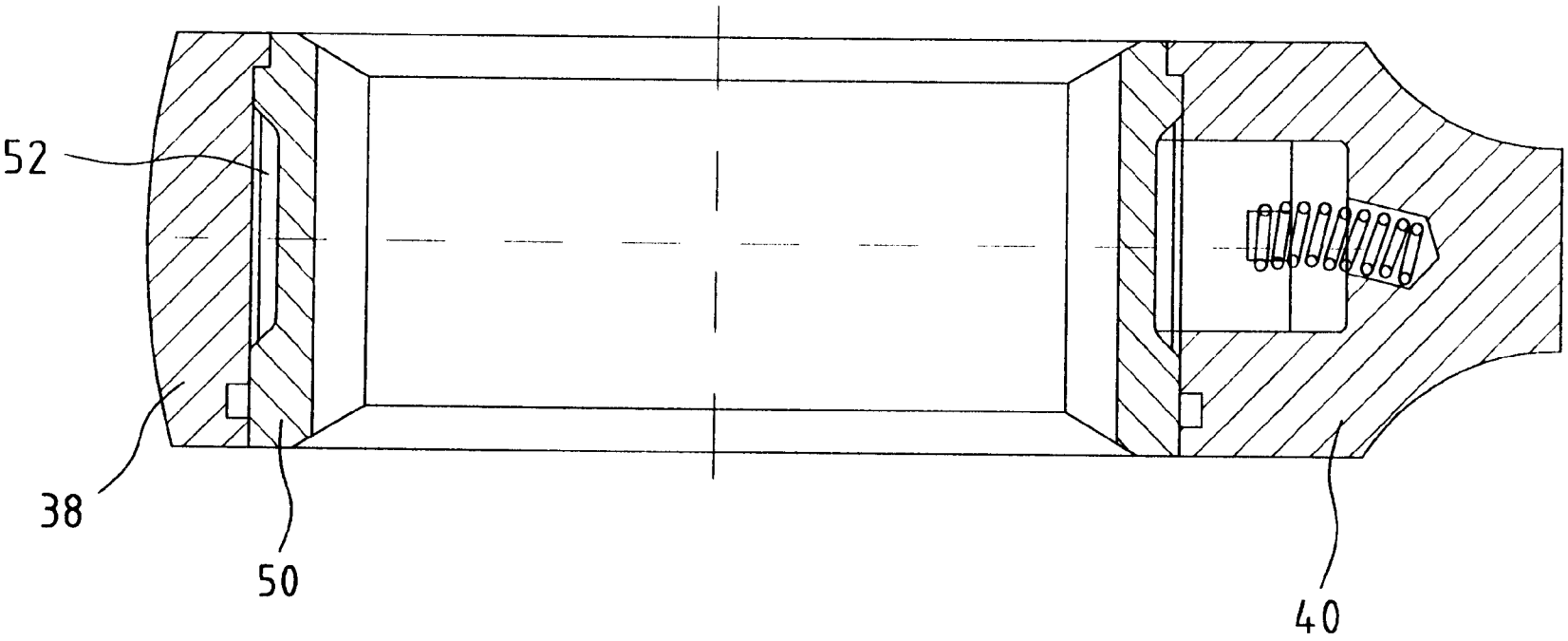
FIG. 24 is a sectional view taken along line 24—24 in FIG. 23.
Figure 25:
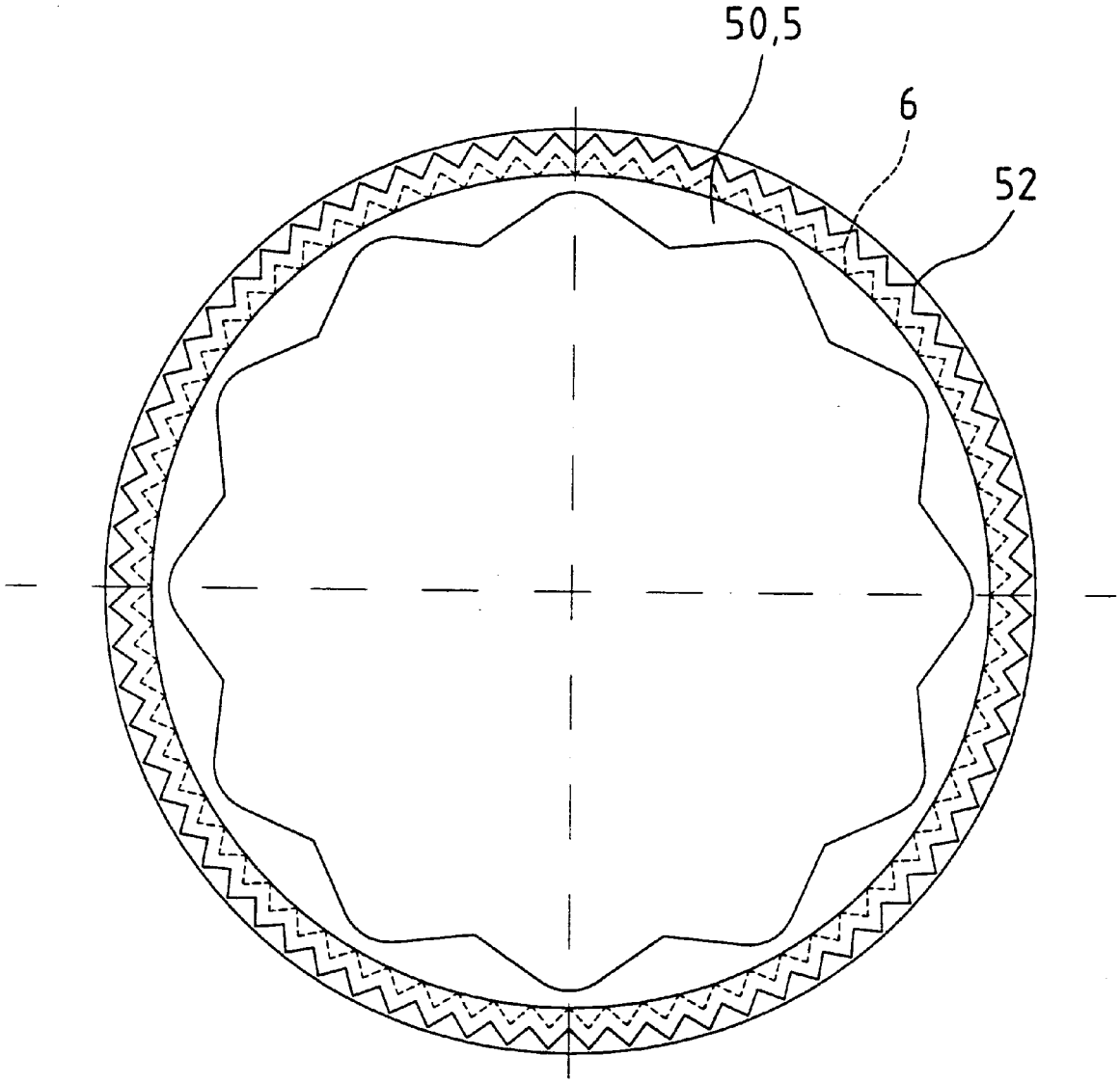
FIG. 25 is a top view of the ratchet wheel in FIG. 21, wherein position of symmetric concave teeth formed according to prior art is illustrated to show difference therebetween.
Figure 26A:
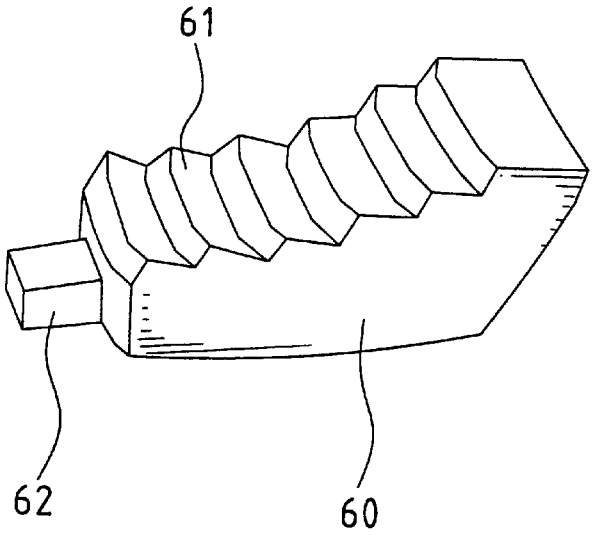
FIG. 26*a* is a perspective view of a pawl for cooperating with the non-arcuate concave teeth of the ratchet wheel in FIG. 23.
Figure 26B:
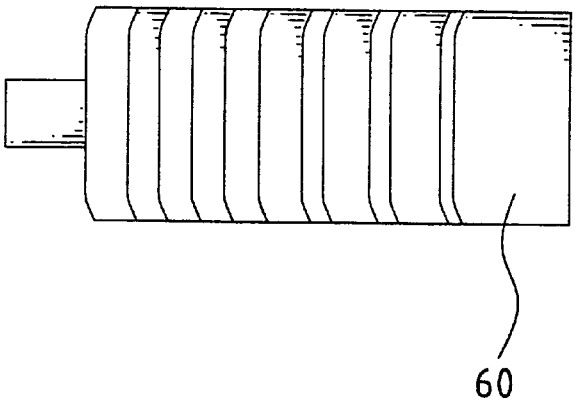
FIG. 26*b* is a top view of the pawl in FIG. 26*a*.
Figure 26C:
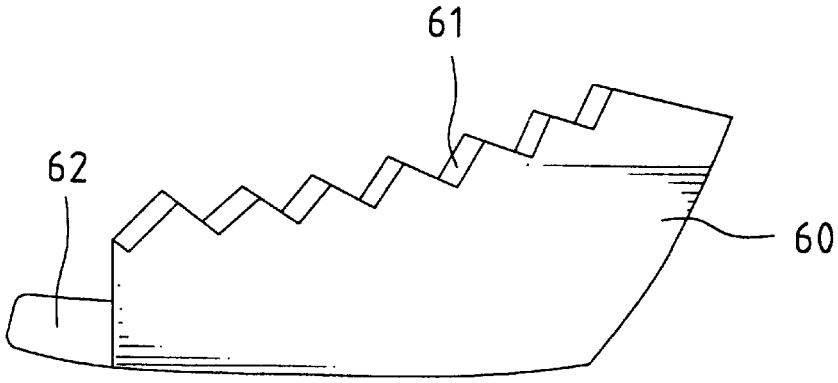
FIG. 26*c* is a side view of the pawl in FIG. 26*a*.

Referring to FIG. 23, the ratchet wheel 50 in accordance with the present invention may be rotatably mounted in a box end 38 of a ring spanner 40. A web area 39 of the ring spanner 40 includes a compartment 36 for receiving a pawl 60. FIGS. 26*a* through 26*c* illustrate the pawl 60. The pawl 60 includes a plurality of teeth 61 that are formed complimentary to the curvatures of the non-arcuate concave teeth 52. An end 62 of the pawl 60 is attached to an end of an elastic member 32 the other end of which is received in a cavity 34 defined in a wall 36*a* defining the compartment 36, best shown in FIG. 23. A detail comparison between the conventional pawl 11 illustrated in FIGS. 8*a* through 8*c*, the pawl 30 of the first embodiment of the present invention illustrated in FIGS. 7*a* through 7*c*, and the pawl 60 of this embodiment illustrated in FIGS. 26*a* through 26*c* would be appreciated. In addition, difference in the wall thickness of the ratchet wheel 50 of the present invention and the wall thickness of conventional ratchet wheel 5 can also be clearly seen in FIG. 25 and by means of comparing FIG. 24 with FIG. 20.

According to the above description, it is appreciated that the ratchet wheel with asymmetric arcuate concave teeth in accordance with the present invention provides a higher torque for operation and has improved structural strength as having a thicker wall in the ratchet wheel. The engagement between the ratchet wheel with asymmetric arcuate concave teeth and the pawl with asymmetric arcuate concave teeth is more reliable. The ratchet wheel with non-arcuate concave teeth in accordance with the present invention reduces the production cost for the ratchet wheel. The ratchet wheel with non-arcuate concave teeth also provides a higher torque for operation when the non-arcuate concave teeth is asymmetric. A spanner with the ratchet wheel/pawl combination in accordance with the present invention can be used in a relatively small space. Nevertheless, the ratchet wheel/pawl combination in accordance with the present invention is not limited to be used in the box end of a ring spanner. Namely, the ratchet wheel/pawl combination may be used in other ratcheting tools such as ratchet wrenches.

Although the invention has been explained in relation to its preferred embodiment, it is to be understood that many other possible modifications and variations can be made without departing from the spirit and scope of the invention as hereinafter claimed.

What is claimed is:

1. A ratchet wheel comprising an inner periphery and an outer periphery, the outer periphery including a plurality of asymmetric arcuate concave teeth each having two sides and an intersection of the two sides, the ratchet wheel including a center, a line from the center to the intersection dividing an angle between the two sides into two unequal portions.

2. A ratchet wheel comprising an inner periphery and an outer periphery, the outer periphery including a plurality of asymmetric non-arcuate concave teeth each having two sides and an intersection of the two sides, the ratchet wheel including a center, a line from the center to the intersection dividing an angle between the two sides into two unequal portions.

3. The ratchet wheel as claimed in claim 2, wherein said asymmetric non-arcuate concave teeth are not formed by cutting.

4. The ratchet wheel as claimed in claim 2, wherein said asymmetric non-arcuate concave teeth are formed by roll squeezing.

5. The ratchet wheel as claimed in claim 2, wherein said asymmetric non-arcuate concave teeth are formed by investment casting.

6. The ratchet wheel as claimed in claim 2, wherein each said asymmetric non-arcuate concave tooth is trapezoidal.

7. The ratchet wheel as claimed in claim 2, wherein each said asymmetric non-arcuate concave tooth is of a shape formed as a result of formation other than cutting.

8. A ratchet wheel comprising an inner periphery and an outer periphery, the outer periphery including a plurality of symmetric non-arcuate concave teeth each having two sides and an intersection of the two sides, the ratchet wheel including a center, a line from the center to the intersection dividing an angle between the two sides into two equal portions.

9. The ratchet wheel as claimed in claim 8, wherein said symmetric non-arcuate concave teeth are not formed by cutting.

10. The ratchet wheel as claimed in claim 8, wherein said symmetric non-arcuate concave teeth are formed by roll squeezing.

11. The ratchet wheel as claimed in claim 8, wherein said symmetric non-arcuate concave teeth are formed by investment casting.

12. The ratchet wheel as claimed in claim 8, wherein each said symmetric non-arcuate concave tooth is trapezoidal.

13. The ratchet wheel as claimed in claim 8, wherein each said symmetric non-arcuate concave tooth is of a shape formed as a result of formation other than cutting.

14. A ratcheting tool comprising:

a handle and an end connected to the handle, the end including a hole, a compartment being defined in an area between the handle and the end;

a ratchet wheel rotatably mounted in the hole of the end, the ratchet wheel comprising an inner periphery and an outer periphery, the outer periphery including a plurality of asymmetric arcuate concave teeth each having two sides and an intersection of the two sides, the ratchet wheel including a center, a line from the center to the intersection dividing an angle between the two sides into two unequal portions;

a pawl slidably mounted in the compartment and engaged with the ratchet wheel, the pawl comprising a plurality of teeth corresponding to the asymmetric arcuate concave teeth of the ratchet wheel; and means for biasing the pawl toward a wall defining the compartment.

15. A ratcheting tool comprising:

a handle and an end connected to the handle, the end including a hole, a compartment being defined in an area between the handle and the end;

a ratchet wheel comprising an inner periphery and an outer periphery, the outer periphery including a plurality of asymmetric non-arcuate concave teeth each having two sides and an intersection of the two sides, the ratchet wheel including a center, a line from the center to the intersection dividing an angle between the two sides into two unequal portions;

a pawl slidably mounted in the compartment and engaged with the ratchet wheel, the pawl comprising a plurality of teeth corresponding to the asymmetric non-arcuate concave teeth of the ratchet wheel; and means for biasing the pawl toward a wall defining the compartment.

16. The ratchet wheel as claimed in claim 15, wherein said asymmetric non-arcuate concave teeth are formed by roll squeezing.

17. The ratchet wheel as claimed in claim 15, wherein each said asymmetric non-arcuate concave tooth is of a shape formed as a result of formation other than cutting.

18. A ratcheting tool comprising:

a handle and an end connected to the handle, the end including a hole, a compartment being defined in an area between the handle and the end;

a ratchet wheel comprising an inner periphery and an outer periphery, the outer periphery including a plurality of symmetric non-arcuate concave teeth each having two sides and an intersection of the two sides, the ratchet wheel including a center, a line from the center to the intersection dividing an angle between the two sides into two equal portions;

a pawl slidably mounted in the compartment and engaged with the ratchet wheel, the pawl comprising a plurality of teeth corresponding to the symmetric non-arcuate concave teeth of the ratchet wheel; and means for biasing the pawl toward a wall defining the compartment.

19. The ratchet wheel as claimed in claim 18, wherein said symmetric non-arcuate concave teeth are formed by roll squeezing.

20. The ratchet wheel as claimed in claim 18, wherein each said symmetric non-arcuate concave tooth is of a shape formed as a result of formation other than cutting.

* * * * *